US012018490B2

(12) United States Patent
Lenney

(10) Patent No.: US 12,018,490 B2
(45) Date of Patent: Jun. 25, 2024

(54) SINGLE PIECE GUTTER GUARD WITH TRUSS

(71) Applicant: GutterGlove, Inc., Roseville, CA (US)

(72) Inventor: Robert C. Lenney, Lincoln, CA (US)

(73) Assignee: GUTTERGLOVE, INC., Franklin, TN (US)

( * ) Notice: Subject to any disclaimer, the term of this patent is extended or adjusted under 35 U.S.C. 154(b) by 0 days.

(21) Appl. No.: 16/864,089

(22) Filed: Apr. 30, 2020

(65) Prior Publication Data

US 2020/0347605 A1 Nov. 5, 2020

Related U.S. Application Data

(63) Continuation-in-part of application No. 16/862,537, filed on Apr. 29, 2020, now Pat. No. 11,384,544.

(60) Provisional application No. 62/841,438, filed on May 1, 2019, provisional application No. 62/841,387, filed on May 1, 2019, provisional application No. 62/841,427, filed on May 1, 2019.

(51) Int. Cl.

| | |
|---|---|
| ***E04D 13/076*** | (2006.01) |
| ***E04D 13/064*** | (2006.01) |
| ***E04D 13/068*** | (2006.01) |

(52) U.S. Cl.

CPC ..... *E04D 13/076* (2013.01); *E04D 13/064* (2013.01); *E04D 13/068* (2013.01)

(58) Field of Classification Search

CPC .... E04D 13/076; E04D 13/068; E04D 13/064
See application file for complete search history.

(56) References Cited

U.S. PATENT DOCUMENTS

| | | | | |
|---|---|---|---|---|
| 1,732,058 A | | 10/1929 | Martini | |
| 2,229,381 A | | 1/1941 | Grow | |
| 2,288,121 A | | 6/1942 | Sandmeyer | |
| 2,569,568 A | | 10/1951 | Lipshaw | |
| 2,583,422 A | * | 1/1952 | Haddon | E04D 13/076 210/498 |
| 2,669,950 A | * | 2/1954 | Bartholomew | E04D 13/076 52/12 |

(Continued)

FOREIGN PATENT DOCUMENTS

| | | |
|---|---|---|
| AU | 2013201320 | 3/2013 |
| CA | 1310167 | 11/1992 |

(Continued)

OTHER PUBLICATIONS

Valor Gutter Guard's Melt Away Use Guide, published Apr. 2014.

*Primary Examiner* — Jessie T Fonseca
(74) *Attorney, Agent, or Firm* — Jonathan Kidney; Glen Gross; Intelink Law Group, P.C.

(57) ABSTRACT

A gutter guard device is described comprising a bridge member composed of a decking material having a plurality of orifices, and having a roof side and an opposing gutter lip side, at least one truss spanning a top surface of the bridge member from a proximal end of the bridge member's roof side to a proximal end of the bridge member's gutter lip side, a roof attachment member configured to attach to the roof side of the bridge member, and a gutter attachment member configured to attach to the gutter lip side of the bridge member, wherein the roof attachment member, the bridge member and the gutter attachment member are a single piece of material and the device is self-supporting.

32 Claims, 27 Drawing Sheets

(56) References Cited

U.S. PATENT DOCUMENTS 2,674,961 A 4/1954 Lake
2,935,954 A 5/1960 Matthews
2,997,763 A 8/1961 Serfass
3,350,045 A 10/1967 Mayers
3,436,878 A * 4/1969 Singer ..... E04D 13/076 52/12
3,630,383 A 12/1971 Reeves
3,691,343 A 9/1972 Norman
3,925,264 A 12/1975 Corte
3,950,951 A * 4/1976 Zukauskas ..... E04D 13/076 405/119
4,254,595 A 3/1981 Crossien
4,308,696 A 1/1982 Schroeder
4,435,466 A 3/1984 Kuhnel et al.
4,573,290 A 3/1986 Fleming
4,604,837 A 8/1986 Beam
4,646,488 A 3/1987 Burns
4,745,710 A * 5/1988 Davis ..... E04D 13/076 210/473
4,750,300 A 6/1988 Winger
4,755,229 A 7/1988 Armanini
4,769,526 A 9/1988 Taouil
4,827,686 A 5/1989 Stamper
4,941,299 A 7/1990 Sweers
D310,259 S 8/1990 Hitchins
4,949,514 A 8/1990 Weller
4,954,015 A 9/1990 McGowan
4,959,932 A 10/1990 Pfeifer
5,010,696 A * 4/1991 Knittel ..... E04D 13/076 210/474
5,035,092 A 7/1991 Brant
5,038,528 A 8/1991 Brant
5,044,581 A 9/1991 Dressler
5,067,675 A 11/1991 Brant
5,092,086 A 3/1992 Rognsvoog, Sr.
5,098,045 A 3/1992 Pepper
5,107,635 A 4/1992 Carpenter
5,109,640 A 5/1992 Creson
5,127,200 A 7/1992 Doran
5,181,350 A 1/1993 Meckstroth
5,216,852 A 6/1993 Bemis et al.
5,228,247 A 7/1993 Dressler
5,257,482 A * 11/1993 Sichel ..... E04D 13/076 52/12
5,261,195 A 11/1993 Buckenmaier
5,315,090 A 5/1994 Lowenthal
5,321,920 A * 6/1994 Sichel ..... E04D 13/076 52/12
5,371,979 A 12/1994 Kwiatkowski et al.
5,375,379 A 12/1994 Meckstroth
5,391,858 A 2/1995 Tourangeau et al.
5,398,464 A 3/1995 Jacobs
5,406,754 A 4/1995 Cosby
5,406,755 A * 4/1995 Serano ..... E04D 13/076 210/474
5,406,756 A 4/1995 Bemis et al.
5,438,803 A 8/1995 Blizard, Jr.
5,459,965 A 10/1995 Meckstroth
D364,338 S 11/1995 Cline
5,522,185 A 6/1996 Cline
D372,421 S 8/1996 Cline
5,558,705 A 9/1996 Keemer et al.
5,570,557 A 11/1996 Kwiatkowski et al.
5,617,678 A 4/1997 Morandin
5,640,809 A 6/1997 Iannelli
5,660,001 A 8/1997 Albracht
5,729,931 A 3/1998 Wade
5,759,255 A 6/1998 Venturini et al.
5,813,173 A 9/1998 Way, Sr.
5,836,117 A 11/1998 Johnson
5,842,311 A 12/1998 Morin
5,842,469 A 12/1998 Rapp et al.
5,848,857 A 12/1998 Killworth et al.
5,878,533 A 3/1999 Swanfeld
5,893,240 A 4/1999 Ealer, Sr.
D418,403 S 1/2000 Cline
6,016,631 A 1/2000 Lowrie, III
D419,863 S 2/2000 Mullane
6,035,587 A 3/2000 Dressler
6,134,843 A 10/2000 Tregear
6,194,049 B1 2/2001 Bindschedler-Galli et al.
6,194,519 B1 2/2001 Blalock et al.
6,205,715 B1 3/2001 Rex
6,225,600 B1 5/2001 Burris
6,223,777 B1 6/2001 Smith et al.
6,266,929 B1 7/2001 Cline
6,341,462 B2 1/2002 Kiik et al.
6,349,506 B1 2/2002 Pace
6,363,662 B1 4/2002 Coates
D457,423 S 5/2002 Mullane
6,412,228 B1 7/2002 Meckstroth
6,468,613 B1 10/2002 Kitano
D475,613 S 6/2003 Mullane
6,598,352 B2 7/2003 Higginbotham
6,607,781 B2 8/2003 Joedicke et al.
D481,929 S 11/2003 McNichol
6,543,729 B1 11/2003 Ylonen
6,700,098 B1 3/2004 Wyatt et al.
6,708,452 B1 3/2004 Tenute
6,759,630 B1 7/2004 Tenute
D494,461 S 8/2004 Dressler
D495,595 S 9/2004 Dressler
D499,331 S 12/2004 Dressler
6,933,007 B2 8/2005 Fensel et al.
6,942,419 B2 9/2005 Knak et al.
6,944,991 B2 9/2005 Kim
6,944,992 B2 9/2005 Brochu
6,951,077 B1 10/2005 Higginbotham
6,951,323 B1 10/2005 McNichol
D511,451 S 11/2005 Mullane
6,959,512 B2 11/2005 Cobb
D514,670 S 2/2006 Handley
7,017,614 B2 3/2006 Handley
D519,025 S 4/2006 Dressler
7,056,422 B2 6/2006 Swistun
7,104,012 B1 9/2006 Bayram
7,127,852 B1 10/2006 Dressler
7,174,677 B1 2/2007 Dressler
7,174,688 B2 2/2007 Higginbotham
7,191,564 B2 3/2007 Higginbotham
7,241,500 B2 7/2007 Shiao et al.
7,310,912 B2 12/2007 Lenney
7,340,863 B1 3/2008 Dressler
7,434,358 B2 10/2008 Smith
7,448,167 B2 11/2008 Bachman
7,493,686 B2 2/2009 Barford
7,516,576 B1 4/2009 Mullane
7,597,119 B2 10/2009 Boettner
7,624,541 B2 12/2009 Gentry
7,665,247 B1 * 2/2010 Pratt ..... E04D 13/076 52/12
7,677,271 B2 3/2010 Boettner
7,726,076 B2 6/2010 Staub
7,743,561 B1 * 6/2010 Frederick ..... E04D 13/064 52/11
7,793,465 B2 9/2010 McCann
7,913,458 B2 3/2011 Higginbotham
D638,920 S 5/2011 Ealer, Sr.
7,946,081 B1 * 5/2011 Frederick ..... E04D 13/064 52/11
7,975,435 B2 7/2011 Lenney
8,033,058 B2 10/2011 Block
8,079,183 B2 12/2011 Lenney
8,251,302 B2 8/2012 Sloan, Jr.
8,297,000 B1 * 10/2012 Demartini ..... E04D 13/076 52/12
8,276,321 B2 11/2012 Bell
8,312,677 B2 11/2012 Higginbotham
8,418,410 B2 4/2013 Martin
8,438,788 B2 5/2013 Bell et al.
8,479,454 B2 7/2013 Lenney
8,495,837 B2 7/2013 McCoy
8,572,899 B1 11/2013 Pearce et al.

(56) References Cited

U.S. PATENT DOCUMENTS

| | | | | |
|---|---|---|---|---|
| 8,607,827 | B2 | 12/2013 | Bell | |
| 8,677,694 | B2 | 3/2014 | Ash | |
| 8,689,837 | B1 | 4/2014 | Smith | |
| D709,357 | S | 7/2014 | Bell | |
| 8,782,960 | B2 | 7/2014 | Nark | |
| 9,080,328 | B1 | 7/2015 | Smith | |
| D752,722 | S | 3/2016 | Boettner | |
| 9,309,995 | B2 | 4/2016 | Bell | |
| 9,394,694 | B2 | 7/2016 | Iannelli | |
| 9,487,955 | B2 | 11/2016 | Breyer | |
| D790,672 | S | 6/2017 | Benjamin | |
| 9,683,371 | B1 * | 6/2017 | Nitch | E04D 13/064 |
| 9,890,535 | B2 | 2/2018 | Breyer | |
| 9,915,070 | B2 | 3/2018 | Lenney | |
| 9,976,309 | B2 | 5/2018 | Lenney | |
| 9,982,438 | B2 | 5/2018 | Casey | |
| 10,081,937 | B2 | 9/2018 | Elliott | |
| D837,048 | S | 1/2019 | Benjamin et al. | |
| 10,233,647 | B2 | 3/2019 | Benjamin et al. | |
| D878,189 | S | 3/2020 | Benjamin et al. | |
| 10,711,464 | B1 * | 7/2020 | Tatasciore | B01D 39/10 |
| 10,801,208 | B1 * | 10/2020 | Bryer | B01D 29/44 |
| 10,808,408 | B1 * | 10/2020 | Tatasciore | E04D 13/076 |
| 2001/0054625 | A1 | 12/2001 | Iggulden | |
| 2003/0046876 | A1 | 3/2003 | Higginbotham | |
| 2003/0187539 | A1 | 10/2003 | Smith | |
| 2003/0198736 | A1 | 10/2003 | Fensel et al. | |
| 2005/0072114 | A1 | 4/2005 | Shiao et al. | |
| 2005/0235577 | A1 | 10/2005 | Smith | |
| 2005/0257432 | A1 | 11/2005 | Higginbotham | |
| 2005/0279036 | A1 | 12/2005 | Brochu | |
| 2006/0037252 | A1 | 2/2006 | Gosse et al. | |
| 2006/0090404 | A1 | 5/2006 | Lovell | |
| 2006/0117670 | A1 | 6/2006 | Tsioris | |
| 2006/0179723 | A1 | 8/2006 | Robins | |
| 2006/0196124 | A1 | 9/2006 | Bachman | |
| 2006/0213129 | A1 | 9/2006 | Bachman | |
| 2006/0230687 | A1 | 10/2006 | Ealer, Sr. | |
| 2006/0277831 | A1 | 12/2006 | Bachman | |
| 2006/0283096 | A1 | 12/2006 | Bachman | |
| 2006/0288652 | A1 | 12/2006 | Gurr | |
| 2007/0054129 | A1 | 3/2007 | Kalkanoglu et al. | |
| 2007/0065640 | A1 | 3/2007 | Joedicke | |
| 2007/0094939 | A1 | 5/2007 | Bachman | |
| 2007/0107323 | A1 | 5/2007 | Higginbotham | |
| 2007/0199276 | A1 | 8/2007 | Duque | |
| 2007/0218251 | A1 | 8/2007 | Jacobs | |
| 2007/0214731 | A1 * | 9/2007 | Bachman | E04D 13/076 52/12 |
| 2007/0220814 | A1 | 9/2007 | Faulks | |
| 2007/0234647 | A1 | 10/2007 | Higginbotham | |
| 2007/0246449 | A1 | 10/2007 | Bachman | |
| 2007/0193012 | A1 | 11/2007 | Bergman et al. | |
| 2008/0000169 | A1 | 1/2008 | Handley | |
| 2008/0187708 | A1 | 8/2008 | Decker | |
| 2008/0248241 | A1 | 10/2008 | Kalkanoglu et al. | |
| 2009/0056234 | A1 | 3/2009 | Brochu | |
| 2009/0064628 | A1 | 3/2009 | Mellott et al. | |
| 2009/0139180 | A1 | 6/2009 | Kehs et al. | |
| 2009/0300995 | A1 | 12/2009 | Nikolopoulos | |
| 2010/0042579 | A1 | 2/2010 | Larsen et al. | |
| 2011/0047930 | A1 | 3/2011 | Nark | |
| 2011/0049118 | A1 | 3/2011 | Nark | |
| 2011/0056145 | A1 | 3/2011 | Lenney | |
| 2011/0067318 | A1 | 3/2011 | Lenney et al. | |
| 2011/0138698 | A1 | 6/2011 | Neumann | |
| 2011/0253611 | A1 | 10/2011 | Higginbotham | |
| 2012/0042579 | A1 | 2/2012 | McCoy | |
| 2012/0049511 | A1 | 3/2012 | Bell et al. | |
| 2012/0068452 | A1 | 3/2012 | Boettner | |
| 2012/0144759 | A1 | 6/2012 | Higginbotham | |
| 2013/0091780 | A1 | 4/2013 | Robins | |
| 2013/0097943 | A1 | 4/2013 | Higginbotham | |
| 2013/0160377 | A1 | 6/2013 | Sager | |
| 2013/0160378 | A1 * | 6/2013 | Higginbotham | E04D 13/002 52/12 |
| 2013/0284650 | A1 | 10/2013 | Higginbotham | |
| 2014/0013702 | A1 | 1/2014 | Pearce et al. | |
| 2014/0130929 | A1 | 5/2014 | Elliott et al. | |
| 2014/0196400 | A1 | 7/2014 | Bell | |
| 2014/0263001 | A1 | 9/2014 | Higginbotham | |
| 2015/0089883 | A1 | 4/2015 | Peck | |
| 2015/0143756 | A1 | 5/2015 | Higginbotham | |
| 2015/0225959 | A1 * | 8/2015 | Lenney | E04D 13/064 52/12 |
| 2015/0225960 | A1 | 8/2015 | Bryer | |
| 2017/0089071 | A1 | 3/2017 | Smith et al. | |
| 2018/0127981 | A1 * | 5/2018 | Brochu | E04D 13/076 |
| 2018/0179761 | A1 | 6/2018 | Higginbotham | |
| 2019/0277033 | A1 * | 9/2019 | Gori | E04D 13/076 |
| 2020/0021707 | A1 | 7/2020 | Graves | |

FOREIGN PATENT DOCUMENTS

| | | |
|---|---|---|
| CA | 2021168 | 2/2002 |
| CA | 2021169 | 2/2002 |
| CA | 2476351 | 11/2005 |
| CA | 2551297 | 12/2007 |
| CA | 2390777 | 5/2008 |
| CA | 2752598 | 3/2013 |
| CA | 2938647 | 1/2018 |
| EP | 1344640 | 4/2006 |
| EP | 2518226 | 10/2012 |
| FR | 2694775 | 11/1997 |
| JP | 06-146506 | 5/1994 |
| JP | 09228592 | 9/1997 |
| JP | 2000-008559 | 1/2000 |
| KR | 1989-10803 | 7/1989 |
| KR | 1989-23083 | 12/1989 |
| KR | 1998-16228 | 6/1998 |
| WO | WO1999053157 | 10/1999 |

* cited by examiner

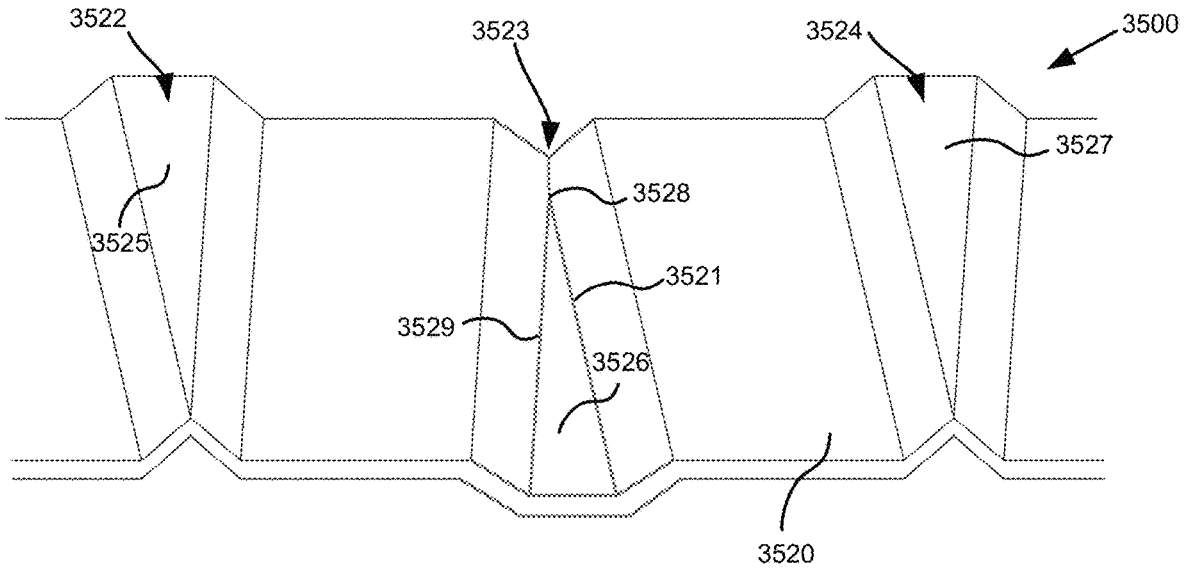
Fig. 83
Fig. 84
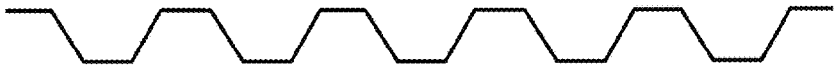
Fig. 85
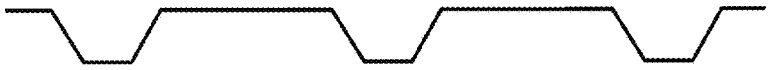
Fig. 86
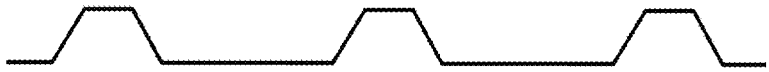
Fig. 87
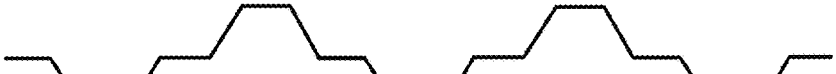
Fig. 88
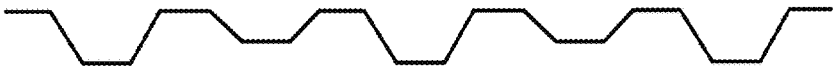

SINGLE PIECE GUTTER GUARD WITH TRUSS

CROSS REFERENCE TO RELATED APPLICATION

This nonprovisional application claims the benefit and priority of U.S. Provisional Application No. 62/841,427 titled "One-piece Truss Gutter Bridge Gutter Guard," filed on May 1, 2018; U.S. Provisional Application No. 62/841,438 titled "One-piece Truss Gutter Bridge with Irregular Grooves Gutter Guard," filed on May 1, 2019; U.S. Provisional Patent Application No. 62/841,387, filed on May 1, 2019, titled "Bifurcated Arched Gutter Bridge Gutter Guard"; and U.S. Non-provisional patent application Ser. No. 16/862,537, filed on Apr. 29, 2020, titled "Gutter Guard with Grooves;" wherein the above-identified applications are incorporated herein by reference in their entireties.

BACKGROUND

Field

This invention relates to gutter guards and protecting gutters from having debris entering the gutter while still allowing water to flow into the gutter.

Description of Related Art

Rain gutters are generally attached to buildings or structures that have a pitched roof. The gutters are designed to collect and divert rainwater that runs off the roof. The gutter channels the rainwater (water) to downspouts that are connected to the bottom of the gutter at various locations. The downspouts divert the water to the ground surface or underground drainage system and away from the building.

Gutters have a large opening, which runs parallel to the roofline, to collect water. A drawback of this large opening is that debris, such as leaves, pine needles and the like can readily enter the opening and eventually clog the gutter. Once the rain gutter fills up with debris, rainwater can spill over the top and on to the ground, which compromises he effectiveness of the gutter, and causes water damage to the home and erode surrounding landscapes.

A primary solution to obstruct debris from entering a gutter opening is the use of debris preclusion devices, most commonly known in the public as gutter guards. Gutter guards are also generically referred to as gutter covers, eavestrough guards, leaf guards or, alternatively via the more technical terms gutter protection systems, debris obstruction device (DOD), debris preclusion devices (DPD) or gutter bridge, etc. Gutter guards/DOD types abound in the marketplace and the industry is constantly innovating to find more efficient configurations that not only keep debris, such as leaves and pine needles out of the gutter, but also keep out even smaller particles like tiny roof sand grit. Concomitant with these innovations are the challenges of achieving self-supporting systems that are simple (e.g., low cost, single piece, easy to fabricate, etc.) as well as systems designed to maintain effectiveness (e.g., durable, easy-to-install, minimal maintenance, etc.) in heavy weather conditions.

In view of the above, various systems and methods are elucidated in the following description and figures, that provide innovative solutions to one or more deficiencies of the art.

SUMMARY

The following presents a simplified summary in order to provide a basic understanding of some aspects of the claimed subject matter. This summary is not an extensive overview and is not intended to identify key/critical elements or to delineate the scope of the claimed subject matter. Its purpose is to present some concepts in a simplified form as a prelude to the more detailed description that is presented later.

As one example, one or more embodiments of the exemplary gutter debris obstruction devices, (i.e. gutter guard) utilizes its own truss support.

For keeping costs down to manufacture and for improved performance, one or more embodiments of the exemplary gutter guard devices can utilize one piece of formed perforated sheet material. The perforated sheet material can be entirely perforated or perforated in limited sections.

Further, one or more embodiments of the exemplary gutter guard devices do not require a "separate" framed support under it.

Still further, one or more embodiments of the exemplary gutter guard devices do not require attachment brackets to attach the device to a gutter or a building.

For example, in one aspect of an embodiment, a gutter guard device is provided, comprising: a bridge member composed of a decking material having a plurality of orifices, and having a roof side and an opposing gutter lip side; at least one truss spanning a top surface of the bridge member from a proximal end of the bridge member's roof side to a proximal end of the bridge member's gutter lip side; a roof attachment member configured to attach to the roof side of the bridge member; and a gutter attachment member configured to attach to the gutter lip side of the bridge member, wherein the roof attachment member, the bridge member and the gutter attachment member are a single piece of material and the device is self-supporting.

In another aspect of an embodiment, the above is provided wherein the at least one truss is a plurality of trusses; and/or wherein a structure of the at least one truss is dual-trussed having a first side joined to an opposing second side via a connecting top side; and/or wherein the first and second sides are disposed perpendicular to the bridge member; and/or wherein the at least one truss is disposed at an angle from the bridge member; and/or wherein the plurality of trusses are equidistant from each other; and/or wherein a truss of the plurality of trusses spans the bridge member in a non-orthogonal orientation; and/or wherein the truss of the plurality of trusses is bifurcated; and/or wherein a portion of the at least one truss on at least one of the gutter attachment member and roof attachment member has a reduced profile; and/or wherein the reduced profile is obtained by flattening the portion; and/or wherein a length of the at least one truss is less than a length between the bridge member's roof side and gutter lip side; and/or wherein the at least one truss is made from a separate material from the bridge member; and/or wherein the at least one truss has a cross-sectional profile shape of an inverted "U."; and/or further comprising at least one barricade disposed in the bridge member; and/or wherein the at least one barricade has a shape of at least one of a number, letter, circle, arrow, crescent, bump, dimple, and polygon; and/or wherein the at least one barricade is a plurality of barricades; and/or wherein the at least one barricade is not made from the bridge member's decking material; and/or wherein a roof side first section of the bridge member has a first elevation and a gutter side second section has a second elevation, the two sections being joined by a third section, to form a non-linear bridge member profile, wherein the at least one truss' profile is matched to the bridge member's profile; and/or wherein the first and section elevations are the same and the third section contains an apex, to form a peak; and/or wherein the first and section elevations are the same and the third section contains an inverted apex, to form a trough; and/or wherein the roof attachment element is flexible, allowing it to be deformed into different attachment angles; and/or a profile of the at least one truss is at least one of an upside down T and L; and/or wherein an upper portion of the at least one truss is angled with respect to a lower portion of the at least one truss; and/or further including at least one of a regular and irregular groove disposed in the bridge member between the plurality of trusses; and/or, wherein the at least one groove is a plurality of grooves; and/or wherein a first cross-sectional profile of the at least one groove has a shape of at least one of a hexagon, half-hexagon, triangle, box, sinusoid, off center, dip, and V; and/or wherein a second cross-sectional profile of the at least one groove has a different shape than the first cross-sectional profile's shape; and/or wherein a second cross-sectional profile of the at least one groove has a different size than a size of the first cross-sectional profile's shape; and/or wherein a first groove of the at least one groove is in a reversed orientation to a second groove of the at least one groove; and/or wherein an end profile of the at least one groove forms a train of angled line segments; and/or wherein the train includes a curved segment; and/or further comprising a trough disposed between the gutter side of the bridge member and the gutter attachment member; and/or wherein the trough contains at least one screened window; and/or wherein a truss of the at least one truss is disposed on a bottom of the bridge member.

In yet another aspect of an embodiment, a gutter guard device is provided, comprising: a unitary member having a roof attachment portion, a bridge portion and a gutter attachment portion, wherein the bridge portion has a plurality of orifices, and at least one truss disposed on a top surface of the bridge portion to enable the device to be self-supporting over a gutter, wherein the bridge portion is disposed between the roof attachment portion and the gutter attachment portion.

These and other features are described in, or are apparent from, the following detailed description of various exemplary embodiments of the devices and methods according to this invention.

BRIEF DESCRIPTION OF THE DRAWINGS

Various exemplary embodiments of this invention will be described in detail, with reference to the following figures, wherein:

FIG. 83 displays a front perspective view of a portion another embodiment of an exemplary bridge portion with a plurality of reversed irregular grooves.

FIG. 84 illustrates an exemplary bridge portion having a plurality alternating irregular grooves.

FIG. 85 illustrates an exemplary bridge portion having a plurality of "downward" irregular grooves.

FIG. 86 illustrates an exemplary bridge portion having a plurality of "upward" irregular grooves.

FIG. 87 illustrates an exemplary bridge portion having a plurality of cross plane irregular grooves.

FIG. 88 illustrates an exemplary bridge portion having a plurality of irregular grooves with varying groove heights.

DETAILED DESCRIPTION OF THE DRAWINGS

Figure 1:
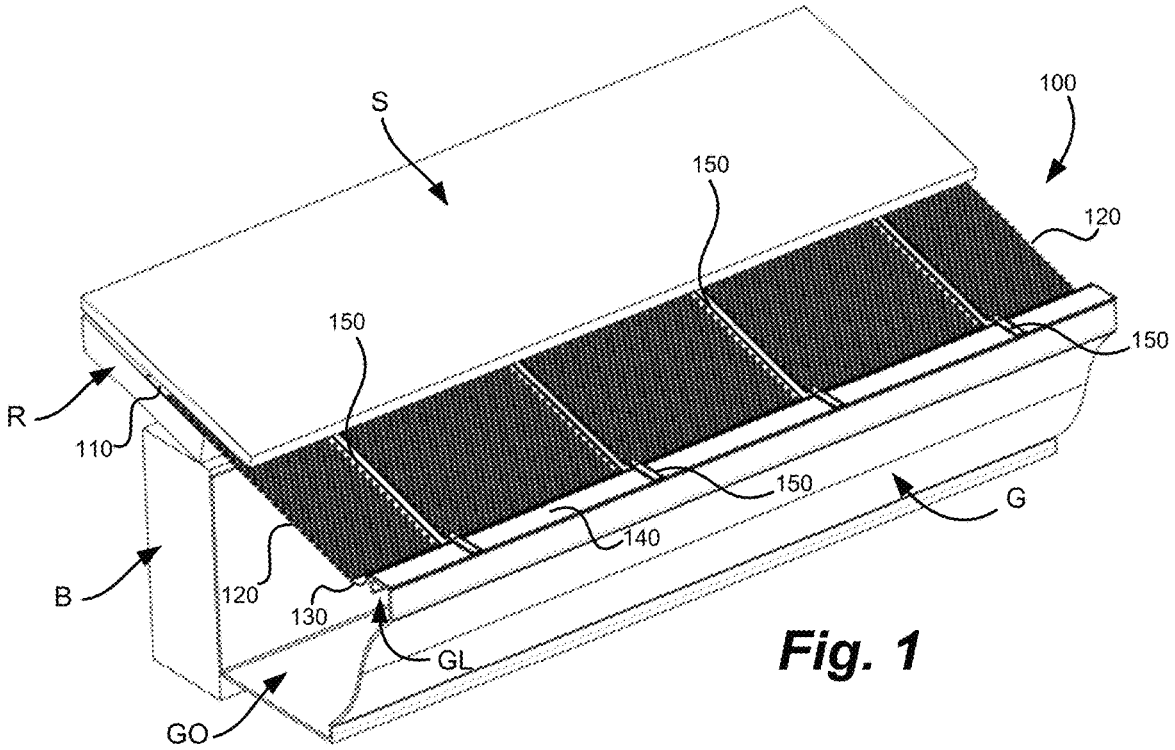
FIG. 1 shows a partial perspective view of the exemplary device installed over a gutter.

It should be appreciated that the most commonly used term to describe a debris obstruction (or preclusion) device (DOD) for a rain gutter is gutter guard. However, as stated above, alternate terms are used in the industry (generally from product branding), denoting the same or essentially same purpose of preventing or obstructing the entrance of external debris (e.g., non-water material) into the rain gutter, whereas the gutter can be protected so as to operate effectively. Thus, recognizing the layman may interchangeably use these terms to broadly refer to such devices, any such use of these different terms throughout this disclosure shall not be interpreted as importing a specific limitation from that particular "brand" or "type" of gutter device. Accordingly, while a DOD or gutter bridge may be a more technically accurate term, unless otherwise expressly stated, the use of the term gutter guard, gutter cover, leaf guards, leaf filter, gutter protection systems, gutter device, gutter guard device, and so forth, may be used herein without loss of generality.

The most conventional DOD is a one-piece gutter guard generally made of sheet materials such as plastics or metals, which tend to have very thin profiles. With such a thin profile, they do not exhibit sufficient internal support for live loads (leaves and other organic debris moving across the gutter guard), or dead loads (leaves and other organic debris sitting static on the gutter guard) and so can collapse after installation.

With the introduction of a stainless-steel type micromesh DOD, a complicated rigid frame type support was required under the micromesh to hold it up so it would not collapse under load, such as seen in U.S. Pat. No. 7,310,912 & 8,479,454 to Lenney and U.S. Pat. No. 7,191,564 & 6,951,077 to Higginbotham.

To avoid the use of complicated support or frame structures, corrugations in a stainless-steel micromesh DOD were first used as seen in U.S. Pat. No. 9,021,747 to Lenney. According to dictionary definitions, corrugations consist of a series of parallel ridges and parallel grooves to give added rigidity and strength. The '747 patent's corrugations provided sufficient rigidity in the (micro)mesh itself so that it could span over the top of a gutter without collapsing.

However, self-supporting corrugated DODs tend to have a large percentage of the decking surface covered with corrugations. Some, for example, have 40% or higher of their decking surface made with these corrugations. While the corrugations provide some rigidity to the mesh, numerous conventionally designed corrugations along the longitudinal axis do not always provide enough of a permeable flat surface along the planar areas of the decking to allow debris to roll off the guard. Therefore, having a "self-supporting" gutter cover with more flat and/or permeable surfaces would address many of the problems in the prior art.

In view of the above, improved designs for allowing the mesh (or bridge) to span the gutter opening using grooves of various types, shapes, and arrangements, as well as different mesh qualities, groove angles and structures and so forth are described below and shown in the following Figures.

Figure 2:
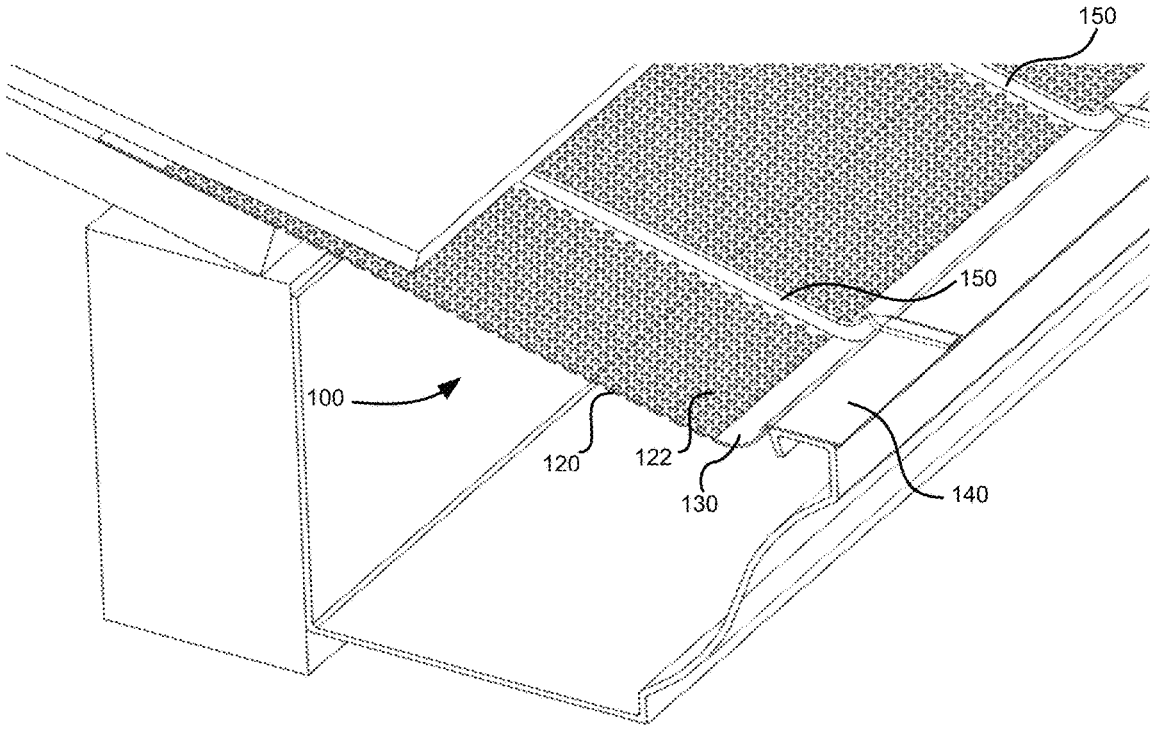
FIG. 2 is a closeup view of FIG. 1.

FIGS. 1-4 display views of an embodiment of an exemplary self-supporting gutter guard device 100. As shown in FIGS. 1 and 2, the device 100 includes a roof attachment member (hereafter referred to as roof attachment portion) 110, a bridge member (hereafter referred to as bridge portion) 120, a trough portion 130, a gutter attachment member 140 (hereafter referred to as gutter attachment portion), and at least one truss 150. The device 100 can be made from a single piece of material, if so desired. For example, as shown in FIGS. 1-4, portions 110, 120, 130, and 140, and trusses 150 are all formed from the single piece of material to define the device 100.

The bridge portion 120 of the device 100 is disposed between the roof attachment portion 110 and the trough portion 130. The trough portion 130 is disposed between the bridge portion 120 and the gutter attachment portion 140. The bridge portion 120 has a roof side 121 and an opposing gutter lip side 123.

It should be noted that while the various Figs. shown here and in other embodiments below appear to illustrate the trusses 150 as being a "solid" material in contrast to an "orificed" material for the bridge portion 120, the trusses 150 may be made from the same orificed bridge material so as to have orifices also in the trusses 150. Thus, having a solid material truss or an orificed material truss can be utilized. Also, portions of the exemplary device 100 may be pre-orificed or orficied during or after forming of the trusses 150.

FIG. 1 shows a partial perspective view of the exemplary device 100, installed over the gutter G. The gutter G is attached to the building B. The building B, the roof R and the gutter G are represented in this Fig. without great detail as any conventional elements of those items may be utilized and are only shown here to show application for the devices of the present invention. It will be appreciated that the roof R may have shingles S, which can be any type of conventional roofing material, including asphalt shingles, slate, tile roofing, etc. It will further be appreciated that the gutter G is configured to capture liquid, generally rainwater RW, that flows down the roof R and into the gutter G. The gutter G has a gutter lip GL. The device 100, when in use is disposed above the gutter opening GO. The device 100 is operably configured to span over the entire gutter opening GO. The device 100 extends from the roof R to the gutter lip GL. The device 100, along with other embodiments, will allow rainwater RW to pass from a top surface of the device 100 through the device 100 and into the gutter G, while preventing a substantial amount of debris from falling into the gutter G. Additionally, the device 100, along with other embodiments, will enable nearly all of the rainwater RW to fall into the gutter G and not run over the gutter lip GL. The device 100 is shown in this figure to be installed onto the building B, which, in this embodiment, is "in-line" or at an acute angle with the roofs R slope angle.

Figure 3:
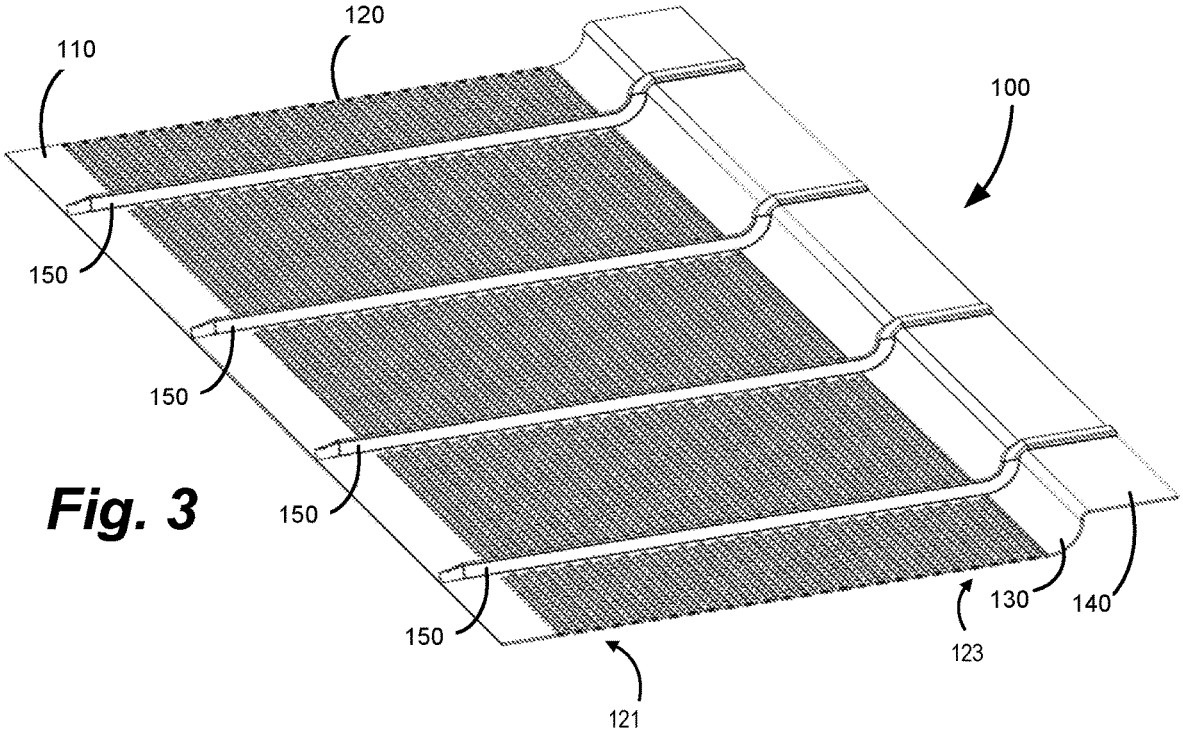
FIG. 3 displays the exemplary device without the gutter.
Figure 4:
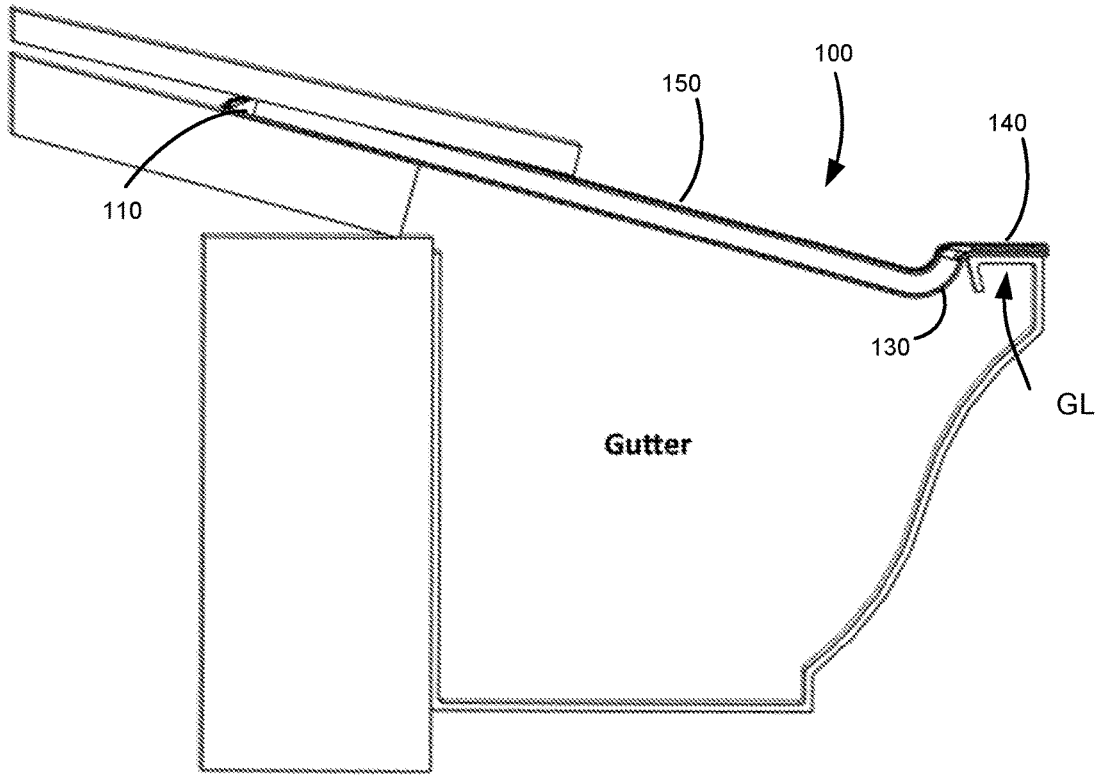
FIG. 4 displays a cross-sectional side view of the device installed over the gutter.

FIG. 3 displays the exemplary device 100, without the gutter G. FIG. 4 displays a cross-sectional side view of the device 100 installed over the gutter G. Trusses 150 provide support for the device 120 to span the gutter opening GO.

The roof attachment portion 110, when in use is operably configured to be attached to the roof R. In this exemplary embodiment, the roof attachment portion 110 is disposed under the shingles S on the roof R. It will be appreciated that in other exemplary embodiments, the roof attachment portion 110 can be directly affixed to the roof R or alternately to the building B with conventional fasteners.

The bridge portion 120 includes a plurality of orifices 122, as shown in FIG. 2. The bridge portion 120 provides bracing support for the plurality of trusses 150. The bridge portion 120 laterally connect adjacent trusses 150. In an exemplary embodiment, the device 100 be made of a single piece of material, thus the lateral support provided by the bridge portion 120 to the trusses 150 is enhanced. This interconnection of the trusses 150 enhances the overall strength of the device 100 and further prevents deflection of the device 100 when spanning the gutter G. The density of orifices 122 can be uniformly spaced (as shown in the Figs.) or non-uniformly spaced, according to design preference. Additionally, different size orifices 122 for different sections of the bridge portion 120 may be implemented, if so desired, as well as orifices that are not parallel to each other. Depending on the size, shape, and structure, the orifice 122 density can be between 4-60 orifices per square inch. Of course, other densities may be utilized, in accordance with the desired performance goals, without departing from the spirit and scope of this disclosure.

The trough portion 130 is disposed slightly below the gutter attachment portion 140, when the device 100 is in use, as shown in FIG. 4. As shown in FIG. 3, the trough portion 130 connects the gutter attachment portion 140 to the bridge portion 120. The cross-sectional shape of the trough portion 130 is shown here as an arc, however, it will be appreciated that the trough portion 130 can, in other exemplary embodiments, have alternate shapes, non-limiting examples being sinusoidal, multi-angled, an acute angle, obtuse angle, a V or L, etc. The trough portion 130 being below the gutter attachment portion 140, when the device 100 is in use, will enhance the drainage of water through the device 100. The trough portion 130 provides a welling area for the water, providing additional time for the water to drain through the orifices 122 in the bridge portion 120, rather than immediately flowing over the gutter attachment portion 140. It will further be appreciated that the trough portion 130 can, for example, in other exemplary embodiments, have orifices (not shown) to further aid in the drainage of rainwater. It should also be noted that the use of the trough portion 130 (below the plane of the gutter attachment portion 140) enables the surface area of the bridge portion 120 to be larger than a design where the bridge portion 120 is directly coupled to the gutter attachment portion 140, thereby providing better water transference into the gutter G. Further, in other embodiments, the trough portion 130 is omitted and the bridge portion 120 is disposed adjacent the gutter attachment portion 140.

Moreover, in some embodiments, the lateral length of the bridge portion 120 may be shorter or longer than shown. That is, a longer arc (or other shape) may be utilized to provide a larger "welling" area for the water. Further, while the embodiments shown illustrate the bridge portion 130 with a uniform lateral length, it should be appreciated that the length may vary between trusses 150 or even be individually non-uniform. As a non-limiting example, the bridge portion 130 can be broadly triangular-shaped (or arc-shaped, etc.) extending into/away from the trough portion 120. Accordingly, one of ordinary skill in the art, upon understanding the effect of the bridge portion 120, may devise various different shapes, arrangements, sizes, and so forth without departing from the spirit and scope of this disclosure.

The gutter attachment portion 140 is operably configured to be fastenable to the gutter G when the device 100 is in use. For example, the gutter attachment portion 140 will overlay the gutter lip GL of the gutter G. It will be appreciated that a variety of conventional fasteners may be utilized to fasten the gutter attachment portion 140 to the gutter lip G, non-limiting examples being screws, rivets, double sided tape, staples, and so forth.

At least one or more trusses 150 can be implemented, as shown in FIGS. 1-4. In some instances, fewer trusses may be possible than shown in these Figs., depending on the bridge portion makeup, truss size, length of the device, etc. For example, even a single truss device may be possible. The trusses 150 are formed in the bridge portion 120. The spacing and number of trusses 150 are understood to be as a function of the length and width of the bridge portion 120, as well as the inherent mechanical rigidity of the decking material used in the bridge portion 120. Therefore, when using less rigid material over larger gutters more trusses maybe necessary. Conversely, with more rigid material over smaller gutters, less trusses may be necessary. As can be appreciated, the choice in number and spacing of trusses 150 is subject to the combination of materials used, size of the gutter, strength desired, etc. and therefore, is variable and design dependent. In an experimental embodiment, each respective truss 150 was set at approximately four inches apart from another. However, it should be appreciated that in other exemplary embodiments, the adjacent trusses 150 can be less or greater than four inches apart, and is variable depending on the design preferences and choices. Also, in some embodiments, the design can be such that the trusses 150 can be non-uniformly spaced from each other. Also, as another non-limiting example of variable truss arrangement, proximal pairs or "neighboring sets" of trusses can be distributed along the device 100, with uniform (or non-uniform) spacings between the pairs/sets.

It is understood that the trusses described herein are differentiated from corrugations, the former generally being a vertical-like structure with no (or little) consideration for permeability to water, its primary purpose being for providing support. Thus, truss formations are vastly superior (strength-wise) to corrugations and therefore allow a significant span between each other, as opposed to corrugations alone.

It should be appreciated that FIGS. 1-4 illustrate embodiments where the trusses 150 extend onto the bridge portion 120 and, in one form or another, onto gutter attachment portion 140. Thus, the trusses 150 can operate to enhance the strength of the bridge portion 120 and gutter attachment portion 140. Moreover, while FIGS. 1-4 illustrate the trusses 150 having the appearance of a uniform height (or shape), it is possible to have the trusses 150 height (or cross sectional shape) vary. Such variations may be in view of the mechanical strength differences of the bridge portion 120, trough portion 130, and gutter attachment portion 140.

The one-piece sheet material that forms the bridge portion 120, also forms the trusses 150. This is in contrast to conventional devices that utilize latticed mesh type material to span the gutter opening. Non-latticed material or solid material trusses, such as shown in various embodiments here, allow for a greater distance between adjacent trusses than a device with webbed or latticed material. This greater distance provides the advantage of greater areas of planar areas for water to drain through the device 100 and into the gutter G.

Figure 5:
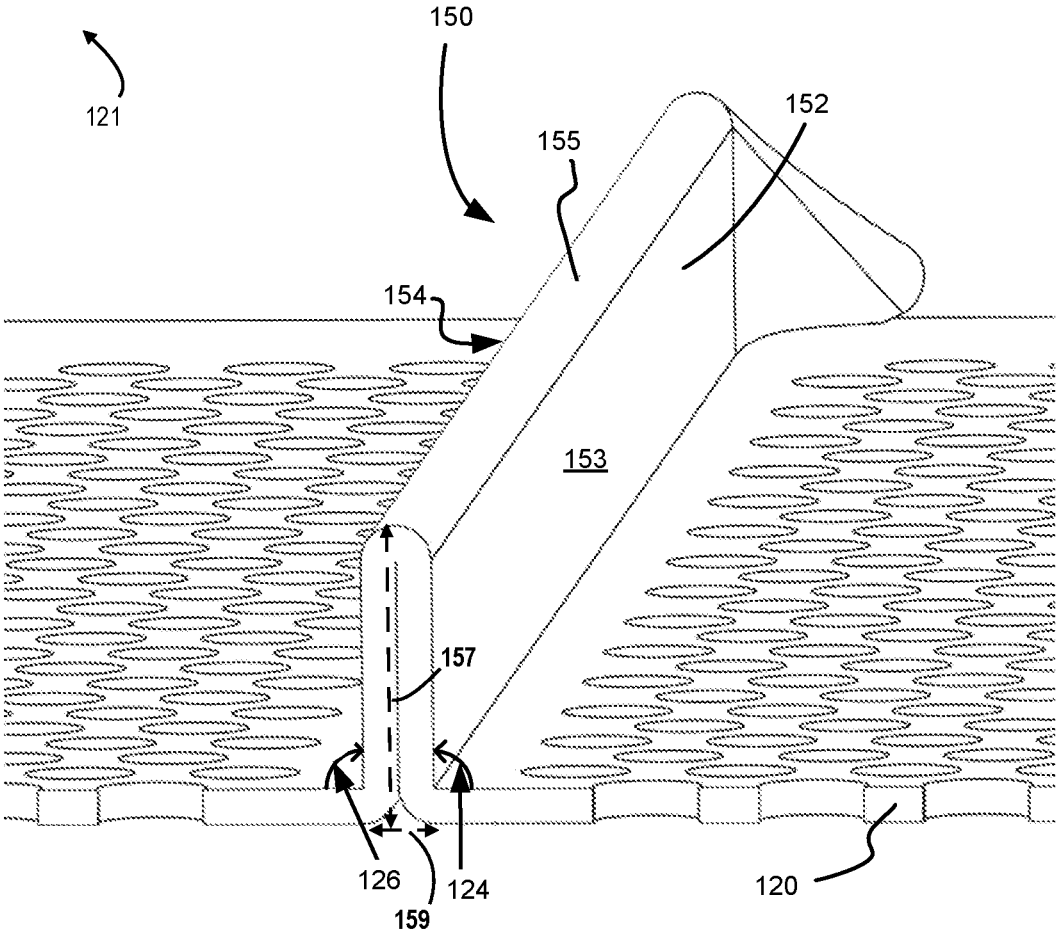
FIG. 5 displays a more detailed partial side perspective view of the bridge portion and a singular truss.

FIG. 5 displays a more detailed partial side view of the bridge portion 120 and a singular truss 152, of the plurality of trusses 150. The truss 152 illustrates how the trusses 150 can be formed from sharp folds in the bridge portion 120. The truss 152 includes a first side 153, a second side 154 and a top 155. The top 155 is disposed between and connects the first and second sides 153 and 154. The truss 152 has an average spanning height 157 that is greater than an average spanning width 159. The one-piece of sheet material that forms the bridge portion 120 is folded vertically about an angle 124 from the bridge portion 120 for forming the first side 153. The sheet material then folds over itself approximately 180 degrees to form the top 155. Side 154 extends from the top 155 back to the bridge portion 120 at angle 126. The angles 124 and 126 are about 90 degrees. But it should be appreciated that angles 124 or 126 in other exemplary embodiments can be greater than 90 degrees (e.g., forming a pyramidal or inverted V-shaped profile, etc.), or only one side angle (e.g., 124 or 126) is less than 90 degrees to have a longitudinally inclined profile. The first and second sides 153 and 154 can form a truss structure with two vertical "adjoining" walls sides, which, from another point of view, can be interpreted as a double "trussed" structure. However, when the interiors of sides 153 and 154 are proximate to each other to touch or nearly touch, the bottom of bridge portion 120 is substantially continuous across the bottom of the truss 152. It should be noted that the interiors of side walls of truss 152 do not necessarily have to touch each other, as there may be a space between. That is, the sides 153 and 154 may form a sharp "A" or "O-like" shape, if so desired. Similarly, while the embodiments shown herein can be formed with a single "fold" in the mesh (or un-orificed portion of the bridge 120) to create the truss 152, it is possible to have multiple folds (e.g., M-shaped or W-shaped) to form more-walled trusses, according to design preference. Further, it is appreciated that the double truss could, in other embodiments, also include a plurality of orifices. It is understood that having a thicker truss can achieve a similar strengthening support structure as compared to having a taller truss. Moreover, greater strength of the truss can also be achieved by using a thicker material or doing multiple folds, as alluded above.

For example, for an experimental device 100 placed on a 5" wide gutter, using a 0.04" thick aluminum or metal sheeting material for the bridge portion, the following results were found comparing fixed truss height varying widths, and adjacent truss distances.

| Gutter Width | Truss Width | Truss Height | Truss Distance |
|---|---|---|---|
| 5 inches | 0.034 inches | 0.125 | 4 inches |
| 5 inches | 0.08 inches | 0.125 | 5 inches |
| 5 inches | 0.12 inches | 0.125 | 6 inches |
| 5 inches | 0.08 inches | 0.125 inches | 5 inches |
| 5 inches | 0.08 inches | 0.157 inches | 5.5 inches |
| 5 inches | 0.08 inches | 0.189 inches | 6 inches |
| 5 inches | 0.08 inches | 0.221 inches | 6.5 inches |
| 5 inches | 0.08 inches | 0.253 inches | 7 inches |
| 5 inches | 0.08 inches | 0.285 inches | 7.5 inches |

As is apparent, different truss heights and widths may be used according to design preference and material choice. Accordingly, in alternate embodiments the truss height may be less than or greater than shown and the width less than or greater than shown.

As detailed in the embodiment shown in FIG. 3 the trusses 150 can extend across the entire bridge portion 120. It is further shown that the trusses 150 can extend over the roof attachment portion 110. Also, the trusses 150 can extend over the trough portion 130. Further, the trusses 150 can extend over the gutter attachment portion 140. However, in variations of the embodiment detailed in FIG. 3, the trusses 150 can be configured so as to not entirely extend across bridge portion 120, or over trough portion 130, or gutter attachment portion 140.

Figure 6:
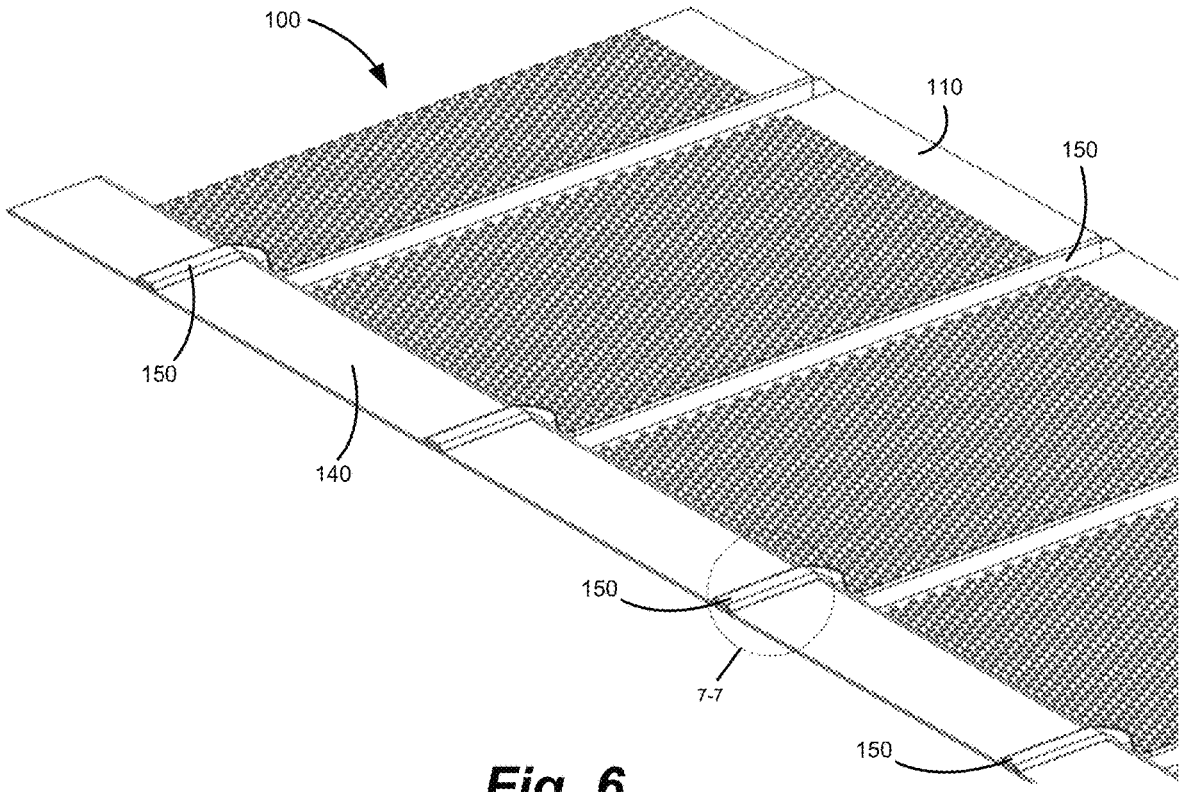
FIG. 6 shows a perspective view of an exemplary device.
Figure 7:
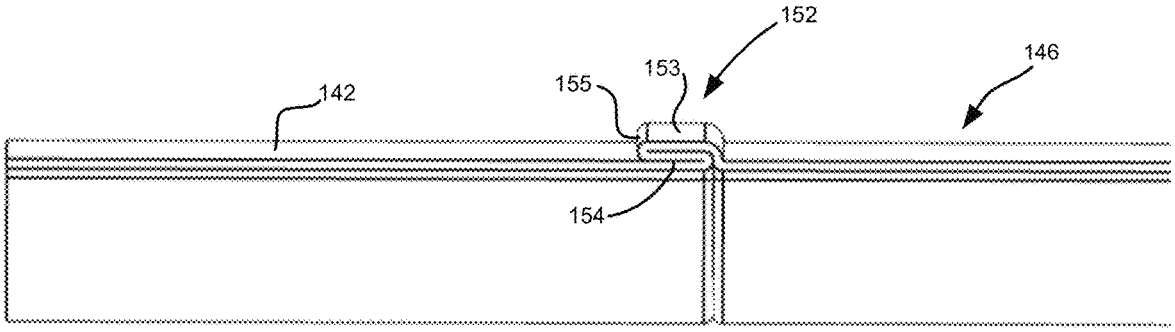
FIG. 7 shows a partially blown up view from Circle 7-7 of FIG. 6

FIG. 6 shows a top perspective view of the device 100 and FIG. 7 shows a partially blown up side view from section Circle 7-7. The portion of the trusses 150 over the gutter attachment portion 140 can be configured to be substantially flat against the gutter attachment portion 140 (i.e., horizontally inclined), rather than in a vertical arrangement as in the bridge portion 120. In this embodiment the side 154 is disposed adjacent to a top surface 142 of the gutter attachment portion 140. It will be appreciated that in alternate embodiments, the other side 153 of the truss 152 can be disposed adjacent to the top surface 142 of the gutter attachment portion 140. It will be further appreciated that each of the trusses 150 do not have to have the same positioning relative to the gutter attachment portion 140. Further, it will be appreciated that the sides of the truss 152 do not have to be 100% flat against the gutter attachment portion 140.

As can be appreciated, the "flattening" of the gutter attachment section of the trusses 150 can be performed for ease of stacking the device 100, for aesthetic reasons, to reduce its profile to debris flowing off of the device 100, and so forth. Thus, enabling an easier exit of the debris. In some embodiments, the flattened truss section may be crimped or pressed (molded, stamped, heated, etc.) into the gutter attachment portion 140 as a means of, or to further reduce its height. In other embodiments, the flattening may be lessened whereas the trusses 150 may protrude at a greater height than shown in FIG. 7. It is conceivable to have the flattening rate differ for different trusses along the gutter attachment portion 140, to provide differing elevated surfaces (e.g., top of the truss 155). In some embodiments, the flattening can be proxied by shearing off (or mechanically removing) the gutter attachment portion of the trusses 150. In other embodiments, it is conceivable to have the so-called flattened portions flattened by having the side walls "split" out so the profile of the gutter attachment portion of the trusses 150 is similar to a stapled staple. That is, the sides 153 and 154 may be displaced from each other and "flattened" to be planar with top 155, so their interiors are facing the top of the gutter attachment portion 140. As can be seen, various other shapes and ways of "flattening" the truss portions can be used. Therefore, other means or ways to provide the flattening are understood to be within the purview of one of ordinary skill and thus are within the spirit and scope of this disclosure.

Figure 8:
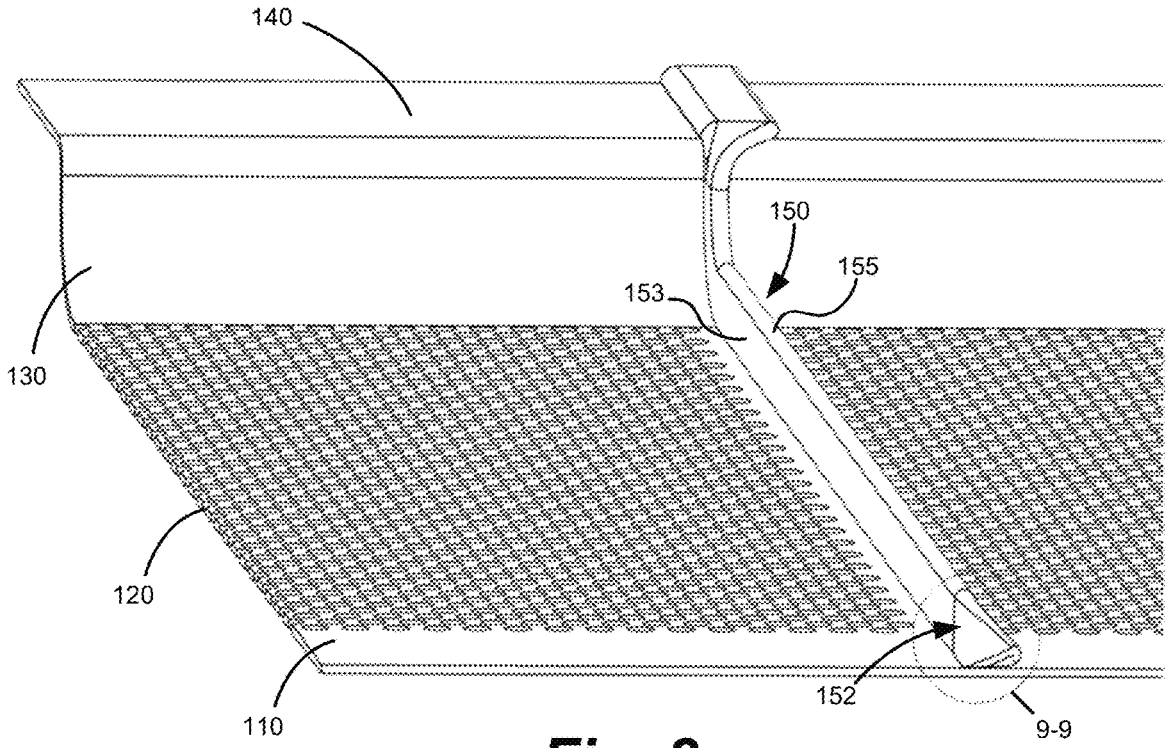
FIG. 8 shows a rear top perspective view of an exemplary device.
Figure 9:
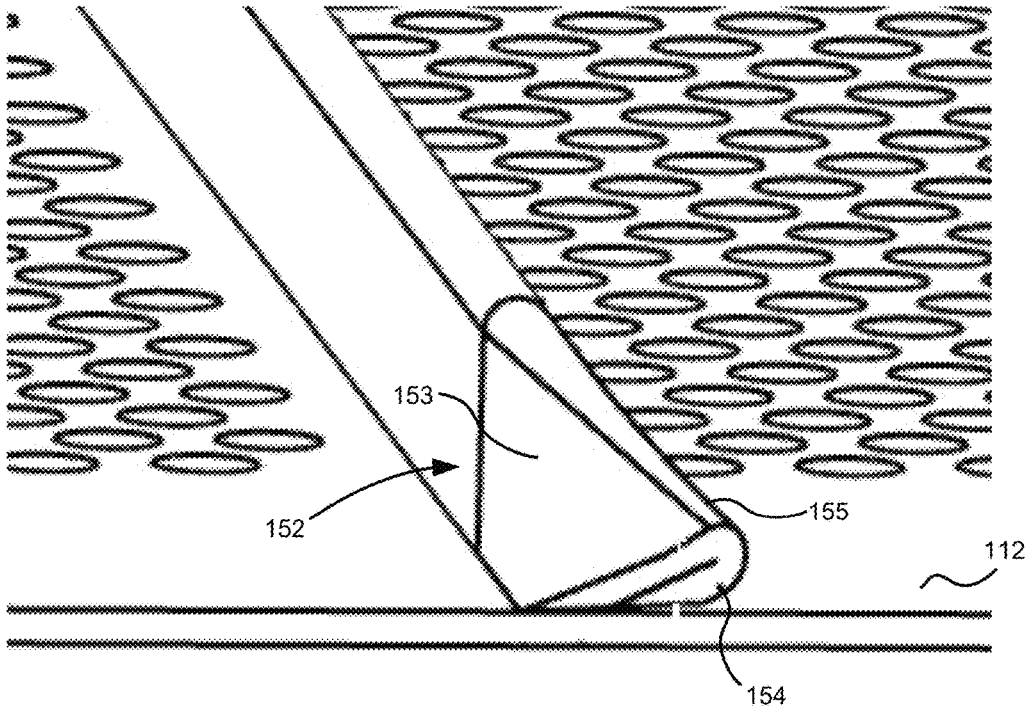
FIG. 9 shows a partially blown up perspective view of FIG. 8's Circle 9-9.

FIG. 8 shows a rear top perspective view of the device 100 and FIG. 9 shows a partially blown up perspective view of Circle 9-9. Here, the trusses 150 can be disposed flat along the surface of roof attachment portion 110. So, as shown here, the trusses 150 over the gutter attachment portion 140 may be flattened as well as the roof attachment portion 110, versus the vertical arrangement shown with the bridge portion 120. Having the trusses 150 configured with a flattened profile on the roof attachment portion 110 will aid in allowing the roof attachment portion 110 to be readily disposed under the shingles, when the device 100 is in use. In this embodiment the side 154 is disposed adjacent to a top surface 112 of the roof attachment portion 110. It will be appreciated that the other side 153 of the truss in other exemplary embodiments is disposed adjacent to the top surface of the roof attachment portion 110. It will be further appreciated that the each of the trusses do not have to have the same positioning relative to the roof attachment portion 110. Further, it will be appreciated that the trusses do not have to be 100% flat against the roof attachment portion. As stated above, any means for flattening or variation of the shape of the truss portion over the top surface 112 of the roof attachment portion 110 may be utilized. As a non-limiting example, the roof attachment portion section of the truss may be sheared either in its entirety or partially sheared (e.g., mechanically removed).

It should be appreciated that while the Figs. illustrate the "flattened" sections of the trusses 150 occurring when entering the gutter attachment portion 140 and roof attachment portion 110 of the device 100, it may be desirable to have the flattening being either earlier or later. That is, the flattening can occur at different points along the length of the truss than shown.

Figure 10:
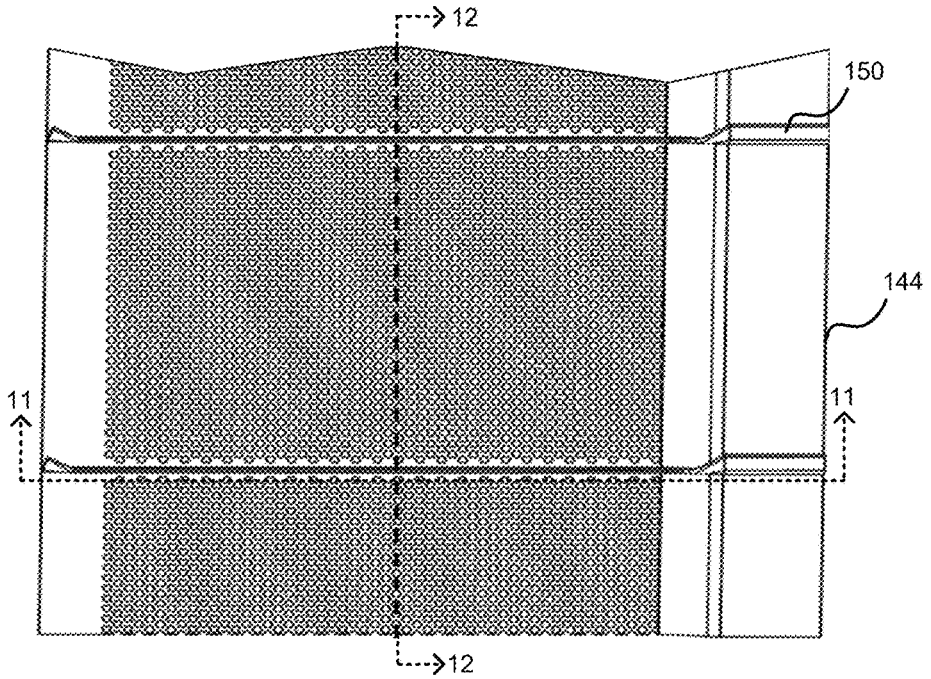
FIG. 10 shows a top view of an exemplary device.
Figure 12:
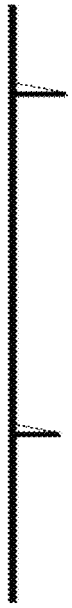
FIG. 12 shows a cross-sectional view of an exemplary device taken along line 12-12 of FIG. 10.
Figure 11:
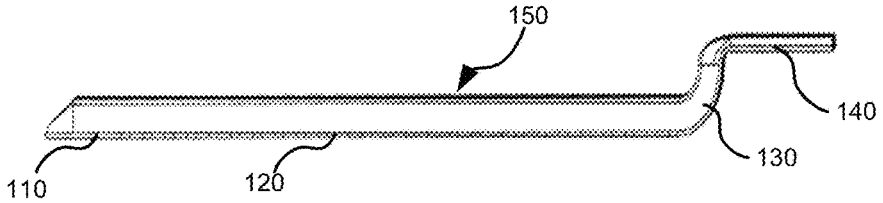
FIG. 11 shows a left side cross-sectional view of an exemplary device, taken along line 11-11 of FIG. 10.
Figure 13:
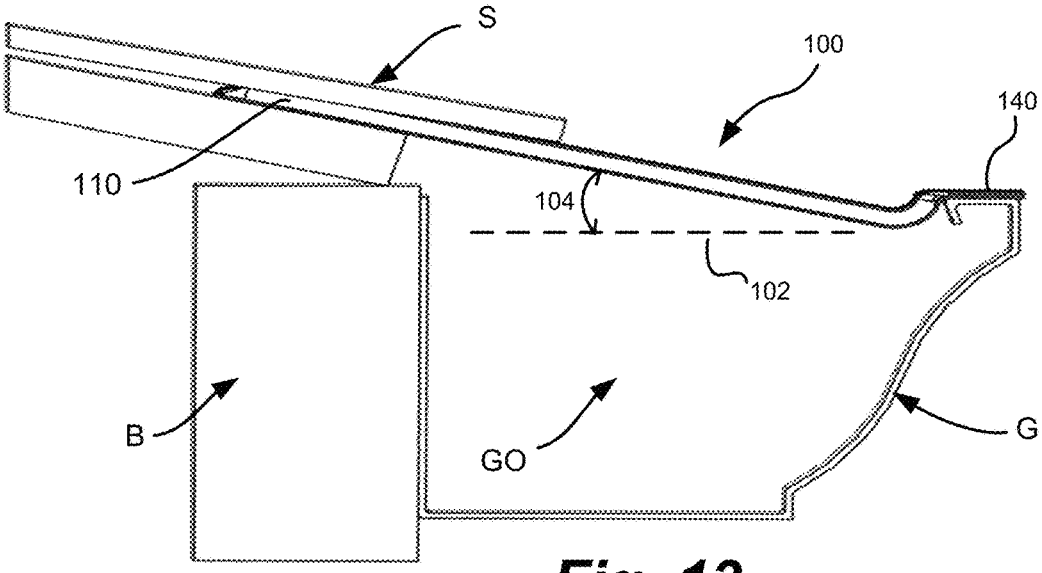
FIG. 13 shows a side view of an exemplary device in use and installed over a gutter.
Figure 14:
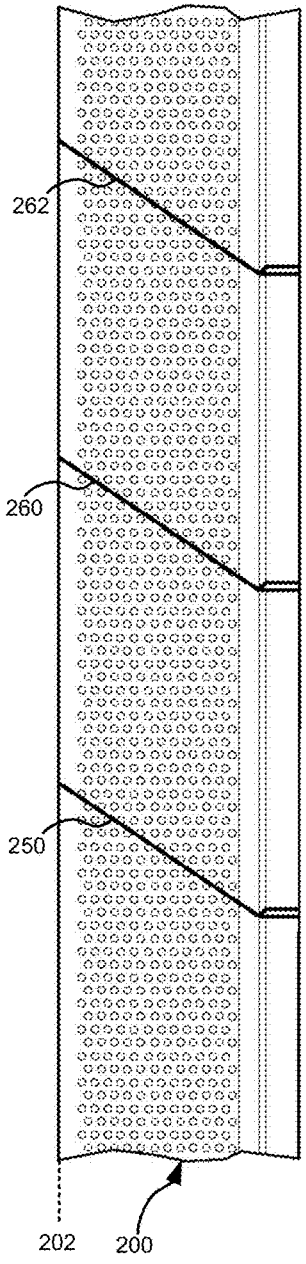
FIG. 14 shows a top view of an alternative exemplary device with non-perpendicular trusses.

FIG. 10 shows a top view of an exemplary device 100. FIG. 11 shows a left side cross-sectional view of an exemplary device 100, taken along line 11-11. FIG. 12 shows a cross-sectional view of an exemplary device 100 taken along line 12-12. FIG. 13 shows a side view of an exemplary device 100 in use and installed over the gutter G. For simplicity, the trusses 150 can be disposed substantially parallel with the bridge portion 120. Further the trusses 150 can be substantially perpendicular to a front edge 144 of the gutter attachment portion 140. In other embodiments, the trusses 150 may have non-parallel orientations.

As shown in FIG. 13, the exemplary device 100 can be installed at an approximate angle 104 relative to a horizontal plane 102. For this example, the angle 104 is about 15 degrees but it is expressly understood that the angle 104 will vary depending on gutter to roof arrangement and/or approximate pitch of the roof. Therefore, angle 104 is dependent on the parameters for installation.

The embodiments described herein can be made out of a sheet material (e.g., aluminum or metal sheeting), which simplifies the construction thereof. In a tested embodiment, a width between the first and second sides 153 and 154 of the trusses 150 was at approximately about 0.04 inches (see FIG. 5). If made of a sheet, non-mesh material, such as aluminum or steel, then such relatively small widths can be achieved. If a conventional micro mesh material is used, such as stainless-steel micro mesh, the minimum width may only be about 0.07 inches. Thus, for a given sheet thickness, it is understood that having a smaller truss width will increase the available planar area between the adjacent trusses 150. The greater the planar area, the more orifices can be formed in the bridge portion 120.

With more area of open space for water to penetrate through, water can penetrate with less resistance, and will provide better overall drainage into the gutter. To illustrate this point, comparing a conventionally corrugated planar surface and a trussed planar surface. A decking area (i.e., 100%) may have up to 40% of its surface corrugated, leaving 60% as planar. In contrast, a similar decking area may only require 4% of its area for trusses, leaving 96% as planar. Thus, a truss supported system provides larger areas of penetrable open space than a corrugated supported system.

Also, as the height of the trusses 150 increase, the dynamic load capacity of the exemplary device 100 increases. The height is the dimension of the trusses 150 from the bridge portion 120 to the top 155 of the truss 152, (see for example FIG. 5). Further as the height increases, the lengths from the front to the back of the device 100 can increase. Thus, devices 100, made in accordance with the described embodiments can be designed to cover gutters 12 inches or more, for example.

Table A provides examples of truss height to truss length ratios for determining how long a truss can be when providing support for the one-piece material for an exemplary embodiment made for various gutter widths. Table A shows acceptable specifications for these ratios.

TABLE A

| Truss Height: | Truss Length: | Covers Gutter Width of: |
|---|---|---|
| 0.125 inches | 5.5 inches | 5 inches |
| 0.157 inches | 6.5 inches | 6 inches |
| 0.189 inches | 7.5 inches | 7 inches |
| 0.221 inches | 8.5 inches | 8 inches |
| 0.253 inches | 9.5 inches | 9 inches |
| 0.285 inches | 10.5 inches | 10 inches |
| 0.317 inches | 11.5 inches | 11 inches |
| 0.349 inches | 12.5 inches | 12 inches |

NOTE:
Distance between trusses is 4 inches.

As shown in Table A, as the gutter increases in width by one inch, the height of the truss increases by about approximately 0.032 inches. These values were based on a sheet material of aluminum or steel sheeting having an average orifice size of 0.125 inches with an orifice density of 16 per square inch.

Trusses of the described embodiments increase load capacity of the devices 100 as the height of the truss increases. These trusses also allow for greater distance from each other on the device 100. Thus, fewer trusses on the device 100 are needed, which in turn provides a greater surface area on the bridge portion of the device 100. Fewer trusses also means less effort and less material to manufacture, thus saving manufacturing costs.

Table B provides some examples of Truss-Height to Truss-Distance from each other ratios on a 5 Inch Gutter. It will be appreciated that as each truss increases in height by 0.032 inches, the distance between trusses increases by 0.25 inches.

TABLE B

Truss-Height To Truss-Distance From Each Other Ratios On A 5 Inch Gutter

| Gutter Width: | Truss Height: | Distance between adjacent Trusses |
|---|---|---|
| 5 inches | 0.125 inches | 4 inches |
| 5 inches | 0.157 inches | 4.25 inches |
| 5 inches | 0.189 inches | 4.5 inches |
| 5 inches | 0.221 inches | 4.75 inches |
| 5 inches | 0.253 inches | 5 inches |
| 5 inches | 0.285 inches | 5.25 inches |

Table C provides examples of Truss-Height to Truss-Distance from each other rations on a 6 Inch Gutter. It will be appreciated that as each truss increases in height by 0.032 inches, the distance between trusses increases by approximately 0.18 inches.

TABLE C

Truss-Height To Truss-Distance From Each Other Ratios On A 6 Inch Gutter

| Gutter Width: | Truss Height: | Distance between adjacent Trusses |
|---|---|---|
| 6 inches | 0.125 inches | 4 inches |
| 6 inches | 0.157 inches | 4.18 inches |
| 6 inches | 0.189 inches | 4.36 inches |
| 6 inches | 0.221 inches | 4.54 inches |
| 6 inches | 0.253 inches | 4.72 inches |
| 6 inches | 0.285 inches | 4.9 inches |

Figure 15:
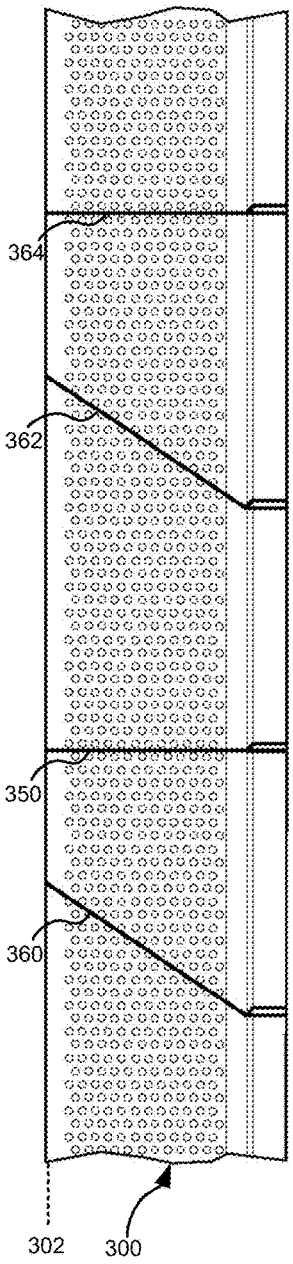
FIG. 15 shows a top view of another alternative exemplary device with varied angled trusses.
Figure 16:
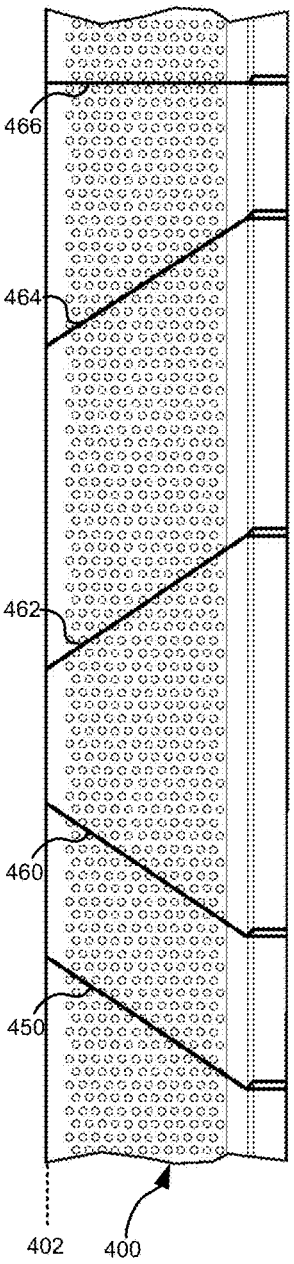
FIG. 16 shows a top view of another alternative exemplary device with differently varied angled trusses.
Figure 17:
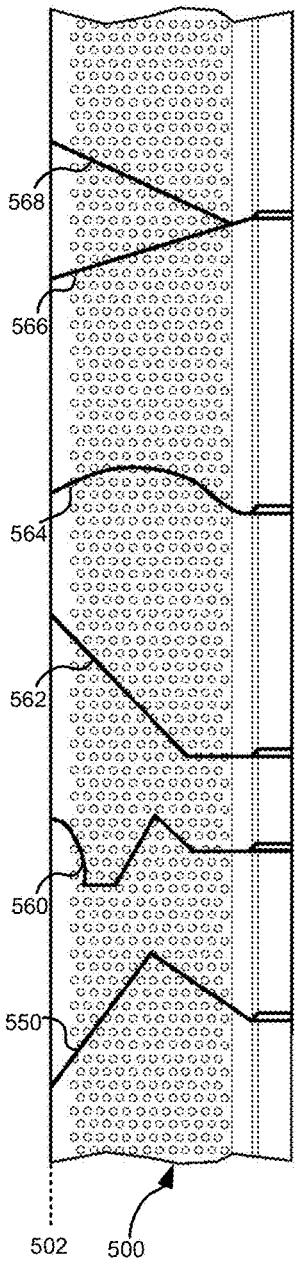
FIG. 17 shows a top view of another alternative exemplary device with curved, multi-angled, joined trusses.

FIGS. 14, 15, 16 and 17 show top views of alternative exemplary embodiments of gutter guards, namely devices 200, 300, 400, and 500, respectively. These devices are similar to device 100, except that the trusses formed in the bridge portions are disposed in various arrangements along the respective devices. The device 200 is shown with trusses 250, 260 and 262 which are disposed at about a 45 degree angle relative to the rear edge (roof attachment portion) of the device 200 and reference line 202. It will be appreciated that these trusses can be formed at nearly any angle relative to the rear edge (and/or front edge). Further the trusses can be at various distances between one another. The device 300 of FIG. 15 illustrates that various truss angles can be combined on the same device. The truss 300 has a truss 350 and a truss 364 which are both disposed about 90 degrees from the rear edges and reference line 302. The truss 300 further has a truss 360 and a truss 362, which are disposed at an angle less than 90 degrees relative to the rear edge. The device 400 of FIG. 16 illustrates trusses 450, 460, 462, 464 and 466, all of which are disposed at various angles relative to the reference line 402. This embodiment illustrates how various truss angles can be utilized on the same device. The device 500 of FIG. 17 illustrates trusses, 550, 560, 562, 564, 566 and 568. These trusses are at various offset angles, curved, etc. and some do not extend "uniformly" across the entire device 500. For example, truss 550 extends partially across the device 500 at one angle and then continues at another angle. Truss 560 includes curved portions and linear portions across the device 500. Truss 562 and truss 550 extend partially across the device 500 at one angle and then continues at another angle to form bifurcated trusses. Truss 564 is non-linear across a portion of the device 500. Trusses 566 and 568 show the possibility of intersecting trusses. It will be appreciated that there are a myriad of variations available for truss angles, shapes, configurations that can be utilized on alternate embodiments and, therefore, are understood to be within the spirit and scope of this disclosure.

Figure 18:
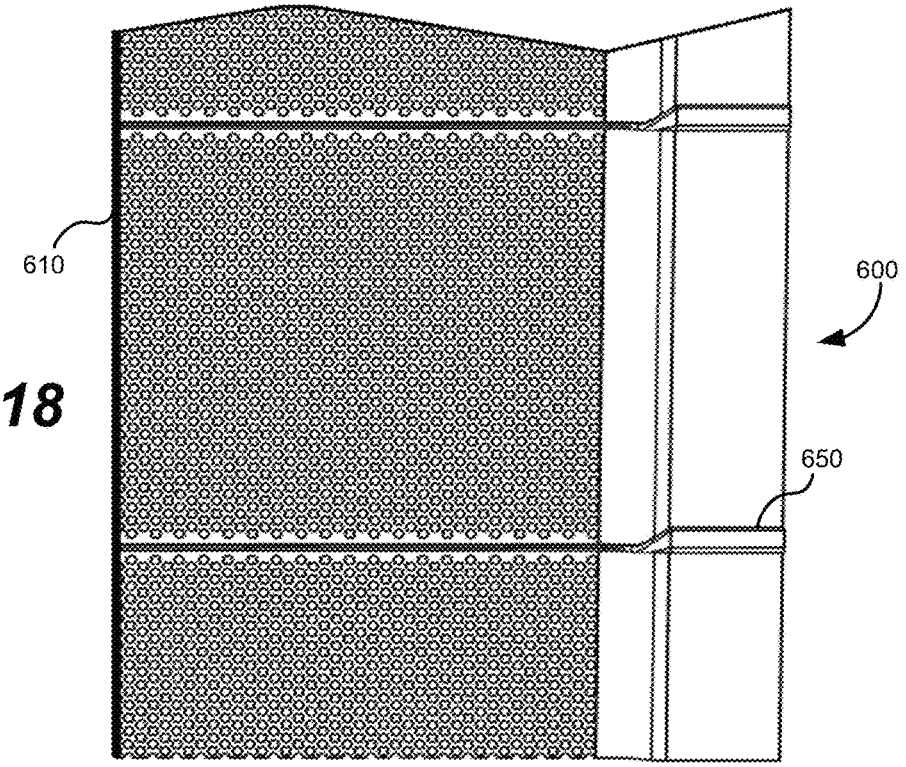
FIG. 18 displays a top view of an exemplary device with an upward angled roof attachment portion.
Figure 19:
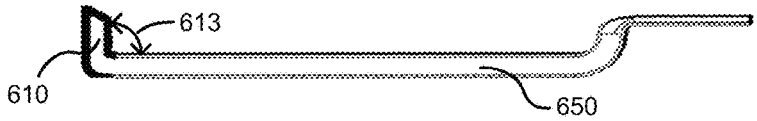
FIG. 19 displays a side view of the embodiment of FIG. 18.
Figure 20:
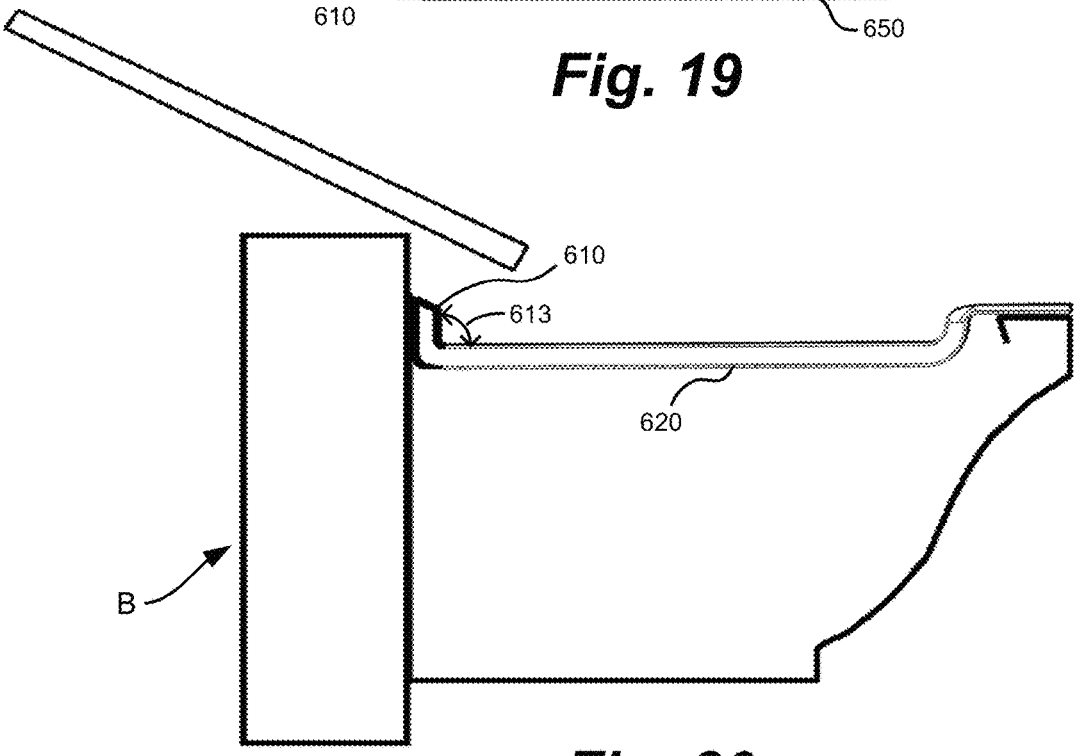
FIG. 20 displays a side of the embodiment of FIG. 18 mounted to a building or gutter.

FIGS. 18, 19 and 20 display another alternative exemplary gutter guard device 600. The device 600 is very similar to the device 100, except the roof attachment portion 610 is disposed at an upward angle 613 relative to the bridge portion 620. FIG. 18 shows a top view of the exemplary device 600 and FIG. 19 shows a side view of the exemplary device 600, whereas FIG. 20 shows a partial cross-sectional side view of the exemplary device 600 installed over a gutter. In this embodiment, the angle 613 is shown to about 90 degrees, thereby providing a parallel surface area for attachment to a side of the building B (or equivalently through a back wall of the gutter G which is attached to the building B). Of course, other upward angles or multi-stepped angles (to have a terminal section of the roof attachment portion 610 parallel to the side of the building B), may be implemented. The device 600 includes at least one truss 650, which is disposed across the entire device 600 and also angles up with the roof attachment portion 610. This embodiment enables the roof attachment portion 610 of the device 600 to be installed directly to the building B rather than under the roof shingles. In other embodiments, however, the trusses may not need to extend over onto the roof attachment portion 610 but terminate prior to reaching the roof attachment portion 610.

Figure 21:
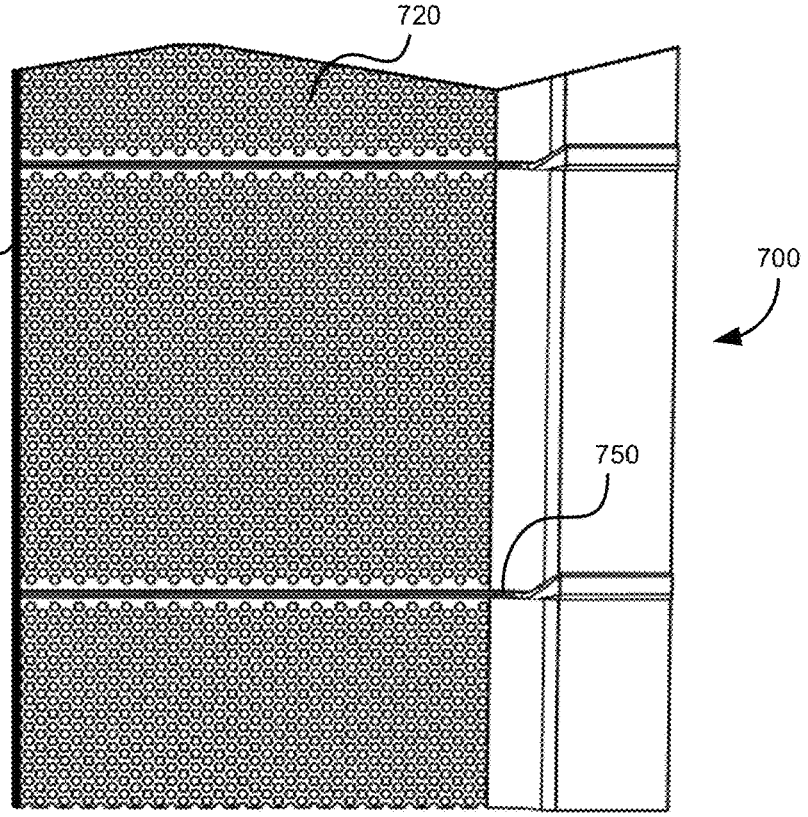
FIG. 21 displays a top view of an exemplary device with a downward angled roof attachment portion.
Figure 22:
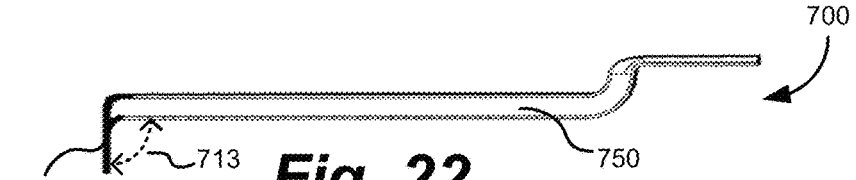
FIG. 22 displays a side view of the embodiment of FIG. 21.
Figure 23:
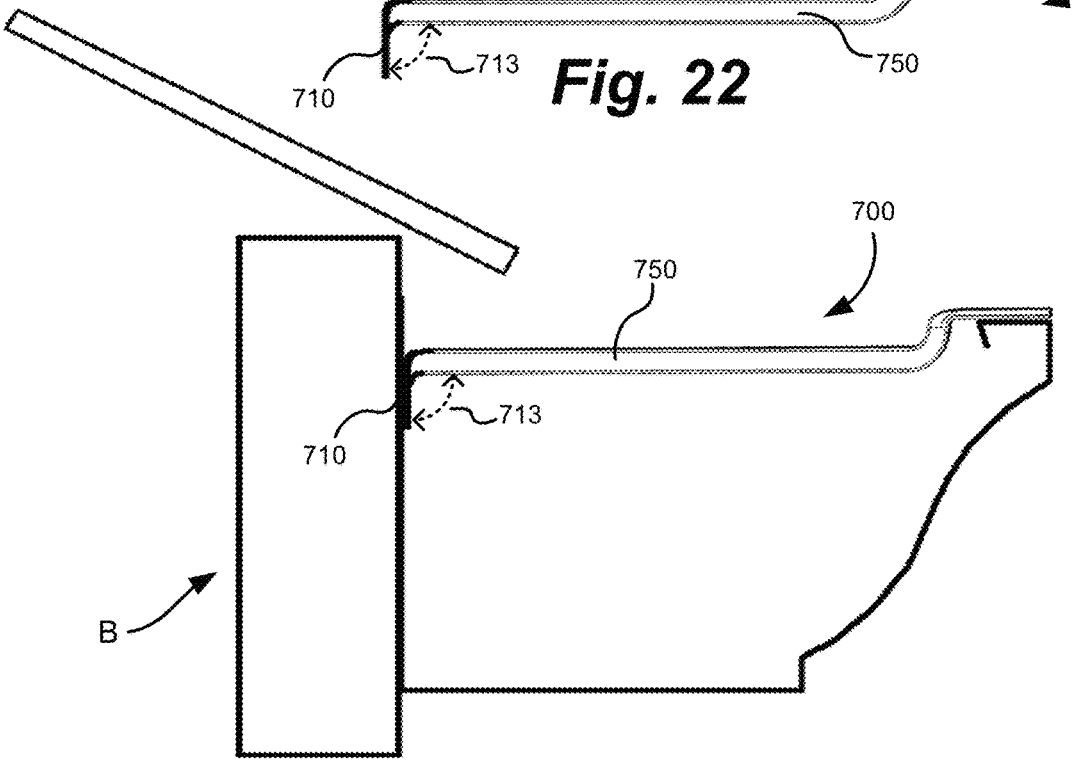
FIG. 23 displays a side of the embodiment of FIG. 21 mounted to a building or gutter.

FIGS. 21, 22 and 23 display another alternative exemplary gutter guard device 700. The exemplary device 700 is very similar to the device 100, except the roof attachment portion 710 is disposed at a downward angle 713 relative to the bridge portion 720. FIG. 21 shows a top view of the exemplary device 700 and FIG. 22 shows a side view of the exemplary device 700, whereas FIG. 23 shows a partial cross-sectional side view of the exemplary device 700 installed over a gutter. In this embodiment the downward angle 713 is about 90 degrees, thereby providing a parallel surface area for attachment to a side of the building B (or equivalently through a back wall of the gutter G which is attached to the building B). Of course, other downward angles or multi-stepped angles (to have a terminal section of the roof attachment portion 610 parallel to the side of the building B) may be implemented. The device 700 includes at least one truss 750, which disposed across the entire device 700 and also angled down with the roof attachment portion 710. This embodiment enables the roof attachment portion 710 of the device 700 to be installed directly to the building rather than under shingles. In other embodiments, however, the trusses may not need to extend over onto the roof attachment portion 710 but may instead terminate prior to reaching the roof attachment portion 710.

Figure 24:
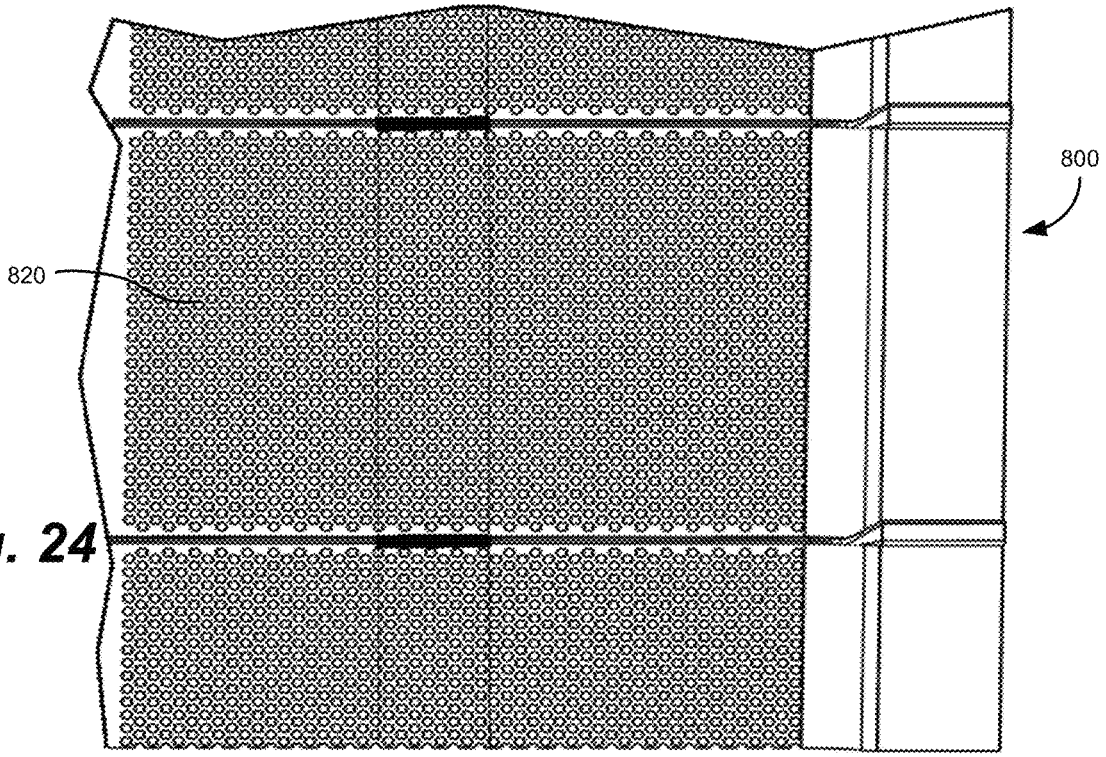
FIG. 24 is a top partial view of another exemplary device with a drop-down mid-deck.
Figure 25:
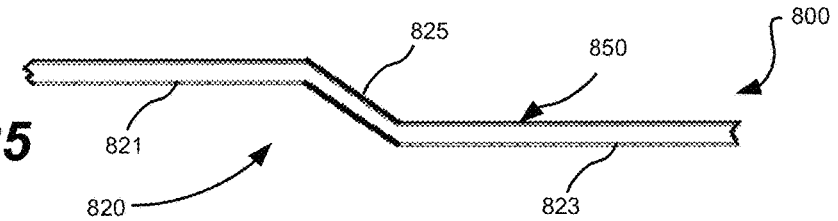
FIG. 25 is a partial side view of the embodiment of FIG. 24.

FIGS. 24 and 25 are views of another alternative exemplary gutter guard device 800. The exemplary device 800 is very similar to the device 100. However, device 800 has a bridge portion 820 with a drop-down deck. FIG. 24 is a top view and FIG. 25 is a partial side view of the bridge portion 820. The bridge portion 820 include a first deck 821 and a second deck 823. In this embodiment the second deck 823 is lower than the first deck 821. The bridge portion 820 also include a mid-deck 825. The mid-deck 825 connects the first and second decks 821 and 823, respectively. In this embodiment, the mid-deck 825 can be generally planar. A truss 850 extends and is formed in all three decks 823, 825, and 821.

Figure 26:
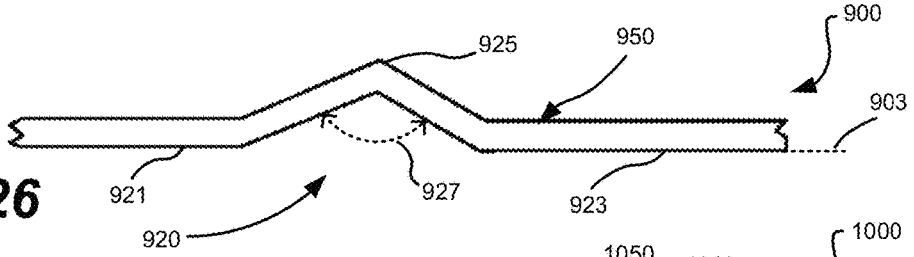
FIG. 26 is a partial side view of another exemplary device with multi-angled mid-deck.

FIG. 26 display a partial side view of another alternative exemplary bridge portion 920 of an exemplary gutter guard device 900. The exemplary device 900 is a variation of device 800, having first, second and third mid-decks 921, 923 and 925, respectively. However, the device's 900 mid-deck 925 is multi-segmented with an angle 927 between its segments so as to provide an elevated "peak" on mid-deck 925. The angle 927 can be any functional angle, and the mid-deck 925 may have more than two segments as well as differing length segments, if so desired. Further, while FIG. 26 shows a mid-deck 925 profile with abrupt angles, it is possible to have curved profile(s) individually or in combination with the mid-deck 925 segments. Additionally, it is understood that the mid-deck 925 may be entirely curved. First and second mid-decks 921 and 923, respectively may be colinear extending up from a horizontal reference 903, or non-colinear, each being at a difference elevation (or angle) from the horizontal reference 903. A truss 950 can extend and be formed in all three decks. This configuration provides a mid-deck profile that aides in the drying of leaves and other debris when the device 900 is in use.

Figure 27:
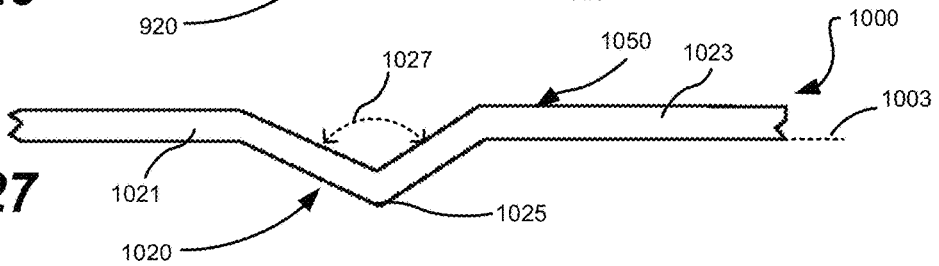
FIG. 27 is a partial side view of another exemplary device with a reversed multi-angled mid-deck.

FIG. 27 displays a partial side view of another alternative exemplary bridge portion 1020 of an exemplary gutter guard device 1000. The exemplary device 1000 is a variation of device 900, having first, second and third mid-decks 1021, 1023 and 1025, respectively. However, the device's 1000 mid-deck 1025 is multi-segmented with an angle 1027 between its segments so as to provide a valley on mid-deck 1025. As stated in FIG. 26, analogous variations in shape, length, segment angle and so forth are equally applicable for this design. A truss 1050 can extend and be formed in all three decks. This configuration provides a mid-deck profile that provides a "welling" area for water when the device 1000 is in use.

As stated above, it will be appreciated that the trusses and bridge portions can be of different shapes other than the side view shapes shown in the above embodiments. For example, the various sections can be in the shape of irregular triangles, arches, squares, hexagons, or any other open polygon or irregular polygon or multi-planed shapes, etc. Further, there can be more than one raised or lowed sections or combinations thereof in the bridge portions. Further the raised or lowered sections can share the same decking plane and face up or share the same decking plane and face down, or even lowered and raised while sharing the same plane.

Figure 28:
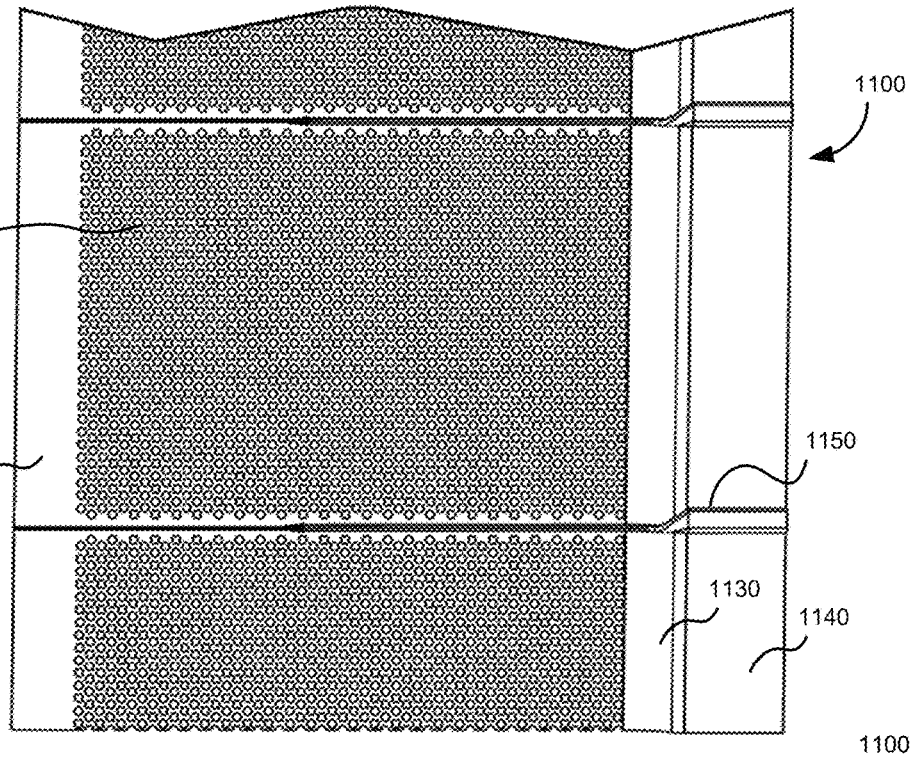
FIG. 28 is a partial top and side views of another exemplary device with partial trusses.
Figure 29:
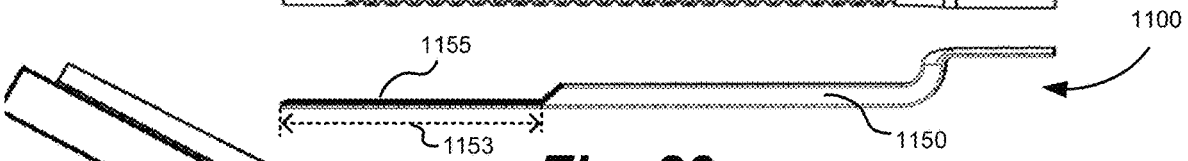
FIG. 29 shows a side view of the embodiment of FIG. 29.

FIGS. 28 and 29 are top and side views, respectively, displaying another exemplary gutter guard device 1100. The exemplary device 1100 is a variation of the device 100, where at least one truss 1150 is disposed vertically over only a portion of the device 1100. FIG. 29 shows a design where the truss 1150 can extend vertically from a gutter attachment portion 1140 to a distance 1153 from a rear edge of the roof attachment portion 1120. It should be appreciated that the truss 1150 may be flattened (or reduced in height) or there may be no truss 1150 in section 1155 of bridge portion 1120 and roof attachment portion 1110. The section 1155 has a length of the distance 1153. It is understood that with the truss "flattened" or omitted in section 1155, the rigidity of that section will be reduced (to provide a greater degree of flexibility as compared to those sections with a vertical truss). Therefore, section 1155 can now be more easily manipulated and bent by an installer into whatever shape necessary to fit on a gutter-to-roof configuration, non-limiting examples being illustrated below. It will be appreciated that in section 1155 a portion of the truss may be omitted altogether, such that the truss only extends partially across the device.

Figure 30:
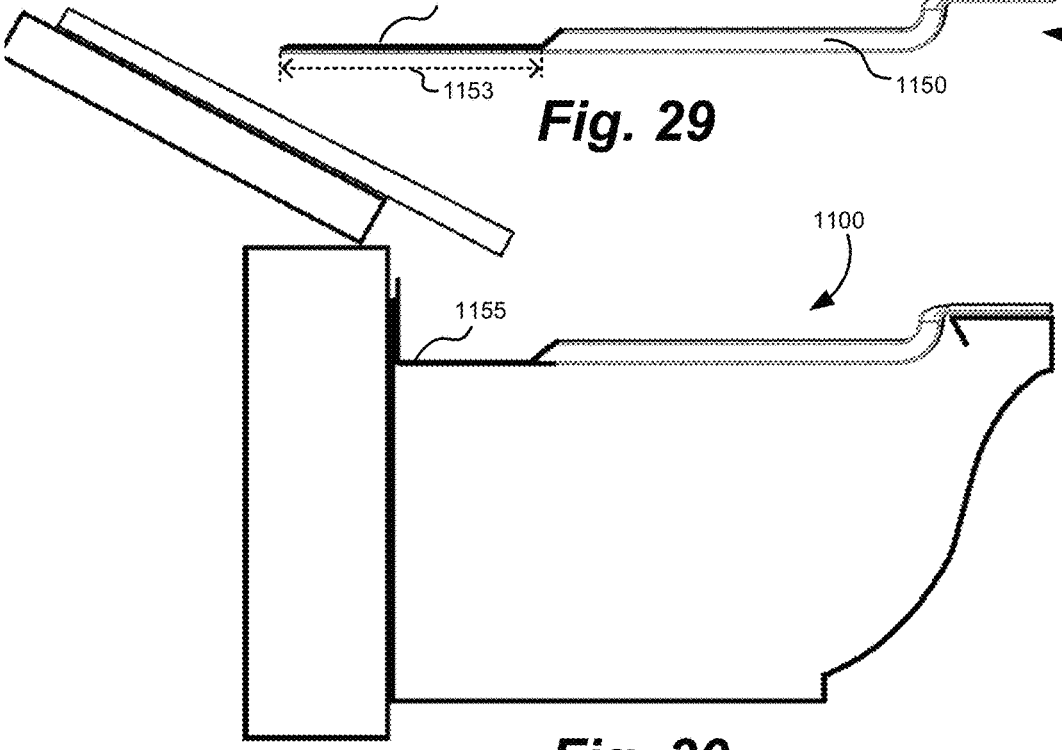
FIG. 30 illustrates an exemplary device installed on a gutter (or building) with an upwardly bent section.
Figure 31:
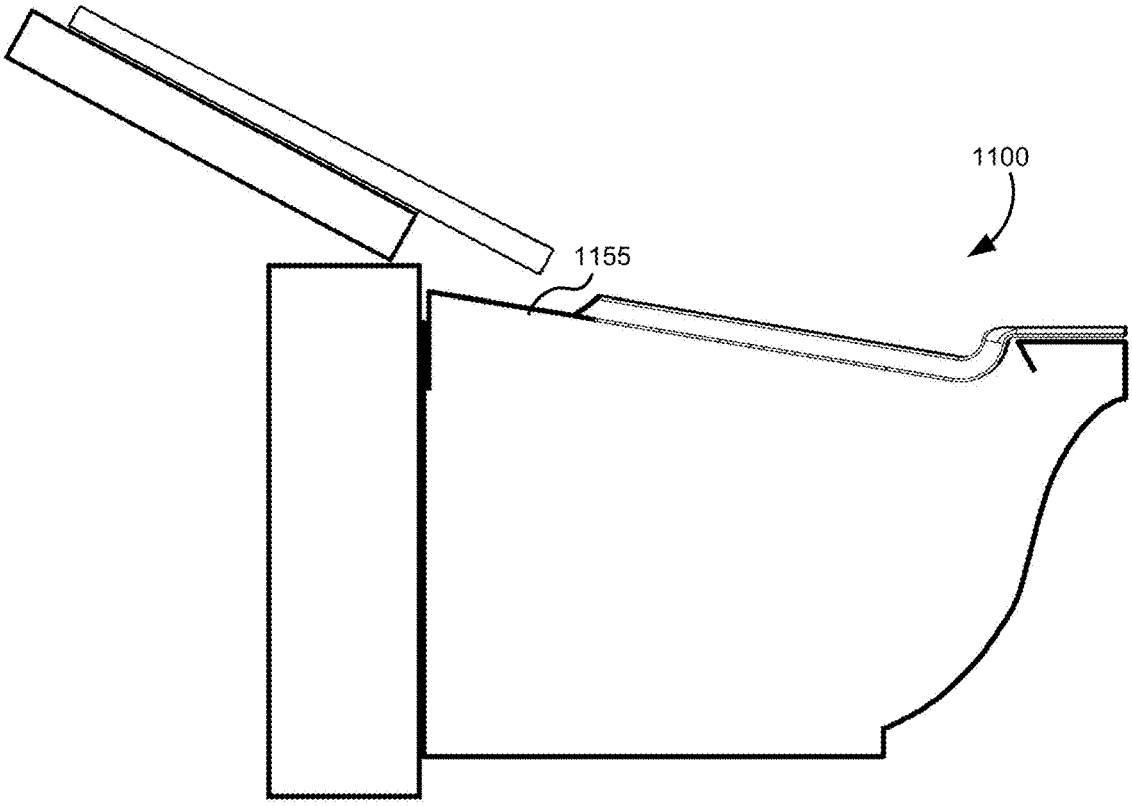
FIG. 31 illustrates an exemplary device installed on a gutter (or building) with a downwardly bent section.
Figure 32:
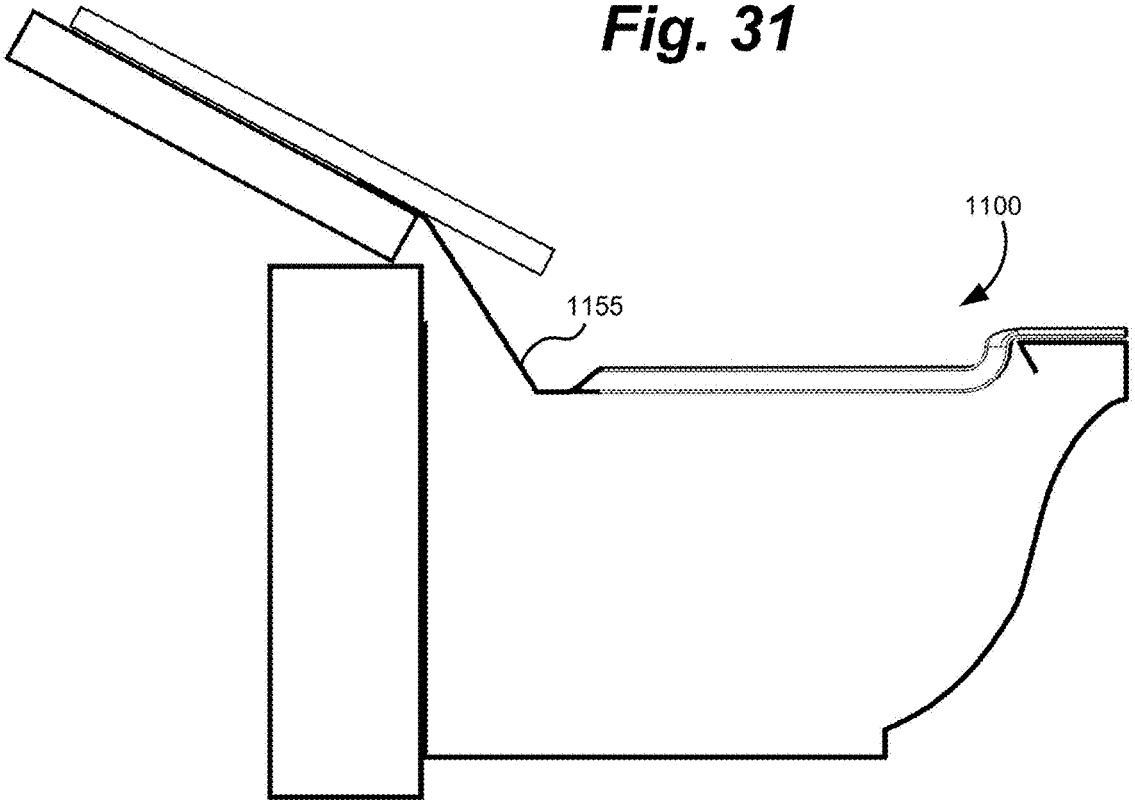
FIG. 32 illustrates an exemplary device installed on a gutter (building) with a multi-bent section.

FIG. 30 illustrates the exemplary device 1100 installed on a gutter with section 1155 bent upward to fit the installation needs. FIG. 31 illustrates the exemplary device 1100 installed on a gutter with section 1155 bent downward to fit the installation needs. FIG. 32 illustrates the exemplary device 1100 installed on a gutter with the section 1155 bent upward and multiple times to fit under the shingles, per the installation needs. Having a flexible section allows the exemplary device 1100 to be easily adjusted by an installer to fit in a plethora of gutter-to-roof configurations. In other embodiments, there may be one or more score/pre-bend lines (or equivalent) in section 1155, providing a greater degree of ease for "bending" by the installer.

Figure 33:
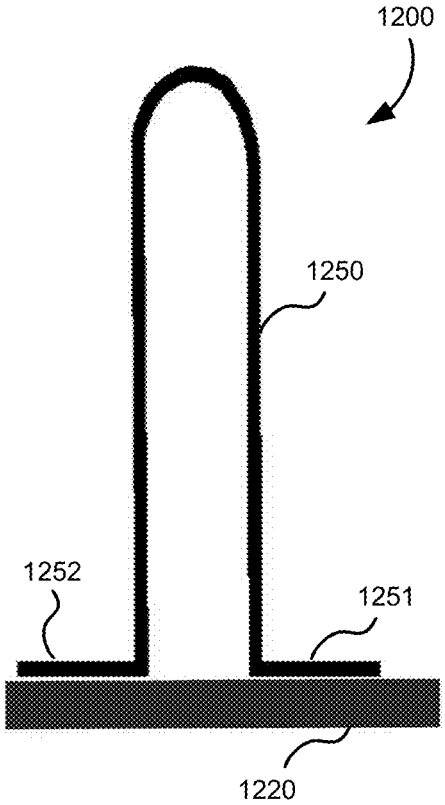
FIG. 33 is a profile view of an exemplary truss structure.
Figure 34:
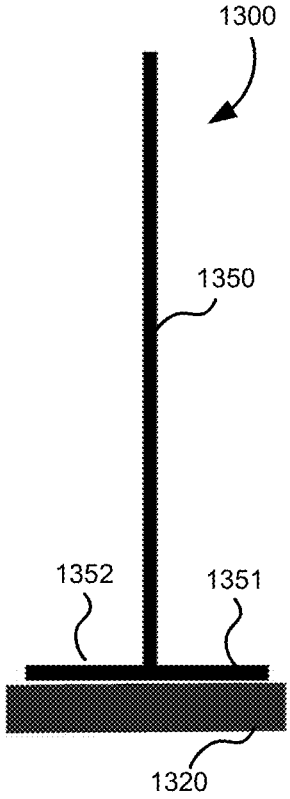
FIG. 34 is a profile view of another exemplary truss structure.
Figure 35:
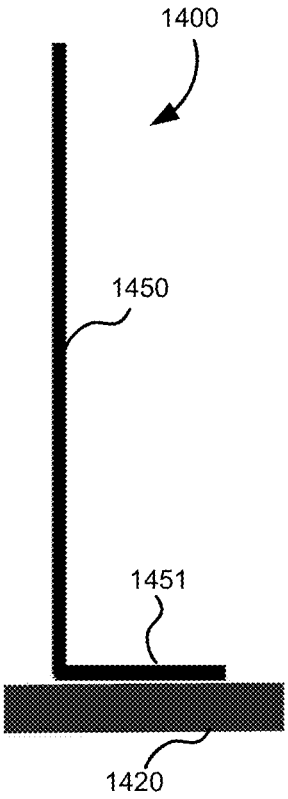
FIG. 35 is a profile view of another exemplary truss structure.

FIGS. 33, 34 and 35 display partial rear views of bridge portions of alternate exemplary gutter guard devices 1200, 1300 and 1400, respectively. The devices 1200, 1300 and 1400 are similar to device 100, however the at least one trusses 1250, 1350 and 1450, respectively are not formed by manipulating the material in the respective bridge portions, 1220, 1320 and 1420, respectively. Rather, the respective trusses are separately formed and attached thereto the respective bridge portions. FIG. 33 shows truss 1250 with an inverted U-shaped profile with "attachment" flanges 1251 and 1252. Flanges 1251 and 1252 may be 90 degrees to the truss 1250, but other angles, shapes, sizes for the flanges 1251, 1252 may be utilized. Moreover, truss 1250 may have asymmetrical flanges. Therefore, truss 1250 can be secured to bridge portion 1220 using flanges 1251 and 1252 (which may extend partially or along all of truss 1250). Any conventional method of attachment or securing can be utilized, such as rivets, welding, heat, molding, pressure, adhesive or other fastening techniques. It will be appreciated that the truss 1250 can in other exemplary embodiments have other profile shapes, such as that of a triangle, square, rectangle or other shapes.

In FIG. 34, truss 1350 is shown as an inverted T-shaped material with two mounting flanges 1351 and 1352. This truss 1350 illustrates a "solid" truss structure in contrast to the "hollow" interior seen in truss 1250 of FIG. 33. Like in FIG. 33, flanges 1351 and 1352 can be disposed and attached to a bridge portion 1320. Likewise, truss 1350 (and flanges 1351, 1352) can be reconfigured or modified in accordance with the variations discussed above.

FIG. 35 shows a truss 1450 having a L-shape, with only one flange 1451 disposed against a bridge portion 1420. Likewise, truss 1450 (and flanges 1451) can be reconfigured or modified in accordance with the variations discussed above.

Not shown, but inherent to the above discussion are possible variations in the shape of the vertical portion of the trusses 1250, 1350, and 1450. For example, the trusses may have a bent or curved profile, or combinations thereof. Accordingly, it is understood that additional variations and modifications to the shapes, sizes, orientations are possible to one of ordinary skill in the art and therefore are within the spirit and scope of this disclosure.

Figure 36:
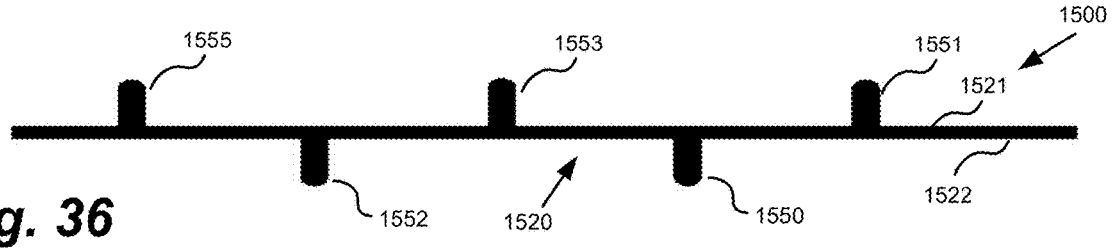
FIG. 36 displays a portion of a rear view of an alternative exemplary bridge portion with trusses on opposing sides.

FIG. 36 displays a portion of a rear view of an alternative embodiment of an exemplary gutter guard device 1500. The exemplary device 1500 has similar elements to device 100, however the at least one truss 1550 includes a plurality of trusses, some of which are disposed on opposing surfaces of a bridge portion 1520. Trusses 1551, 1553 and 1555 are disposed on a top side 1521 of a bridge portion 1520 and trusses 1550 and 1552 are disposed on an opposing, bottom side 1522 of the bridge portion 1520. The trusses in this embodiment are equally spaced from one another. It should be understood that the bottom side trusses are traditionally understood as girders. However, for ease of narrative when discussing embodiments with trusses that are also positioned to be girders, the term truss will be used as shorthand to refer both to "trusses" and "reversed-side" trusses (girders). This broadened generic use of the term truss will only apply to these discussions, understanding its shorthand purpose.

Figure 37:
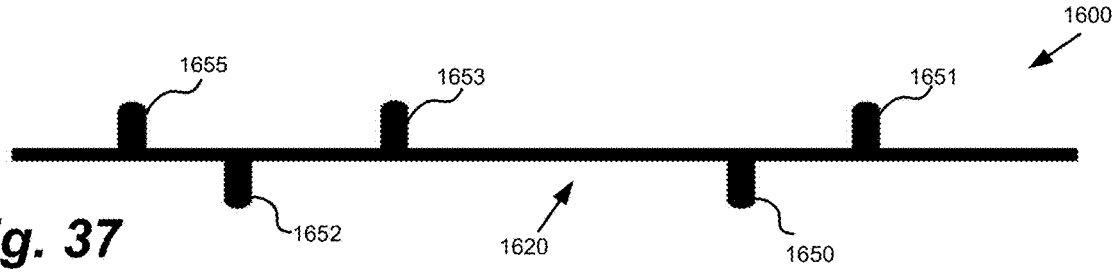
FIG. 37 displays a portion of a rear view of another alternative exemplary bridge portion with non-uniformly spaced trusses on opposing sides.

FIG. 37 displays a portion of a rear view of an alternative embodiment of an exemplary gutter guard device 1600. The exemplary device 1600 is similar to device 1500, however trusses 1650, 1651, 1652, 1653, 1655 are irregularly spaced apart from one another.

Figure 38:
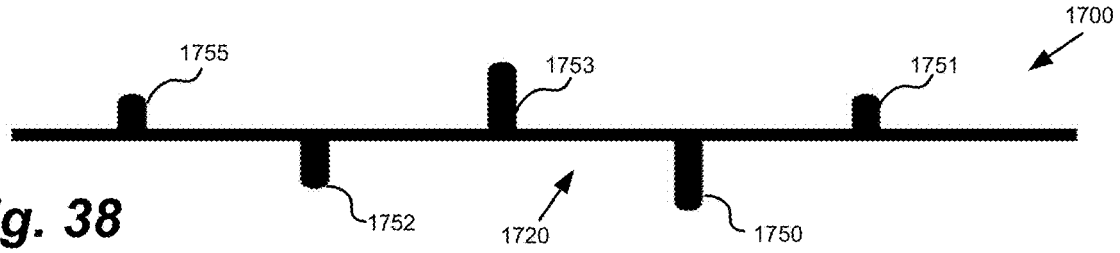
FIG. 38 displays a portion of a rear view of another alternative exemplary bridge portion with varying height trusses on opposing sides.

FIG. 38 displays a portion of a rear view of an alternative embodiment of an exemplary gutter guard device 1700. Device 1700 is similar to device 1500, however, the trusses are shown as not having the same height dimension. Device 1700 includes trusses 1750, 1751, 1752, 1753 and 1755. All of these trusses have different height dimensions. It will be appreciated that in other exemplary embodiments, that the separation between the trusses can vary as well.

Figure 39:
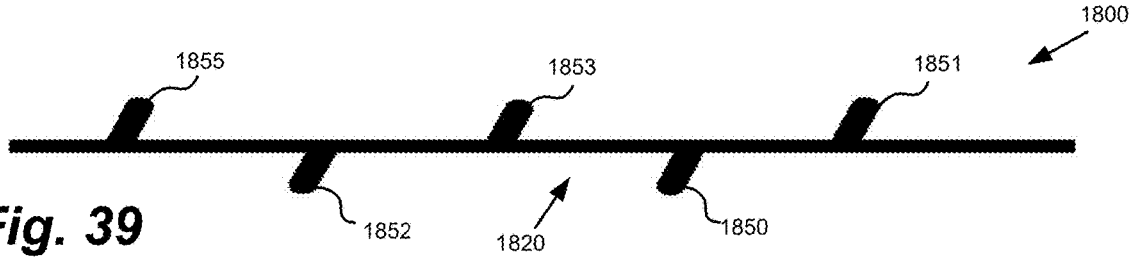
FIG. 39 displays a portion of a rear view of another alternative exemplary bridge portion with angled trusses on opposing sides.

FIG. 39 displays a portion of a rear view of an alternative embodiment of an exemplary gutter guard device 1800. Device 1800 is similar to device 1500, however, device 1800 has trusses 1850, 1851, 1852, 1853 and 1855 disposed on bridge portion 1820 at an angle other than 90 degrees.

Figure 40:
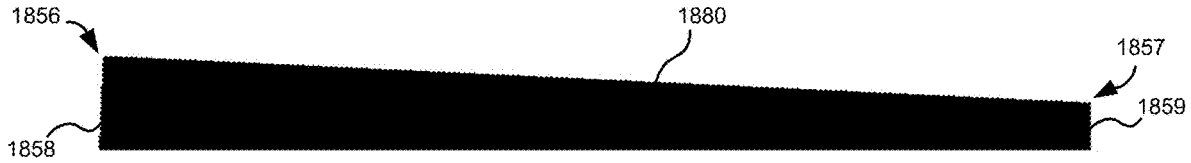
FIG. 40 is a partial side view of a portion of an alternative exemplary bridge portion with a non-uniform height truss.
Figure 41:
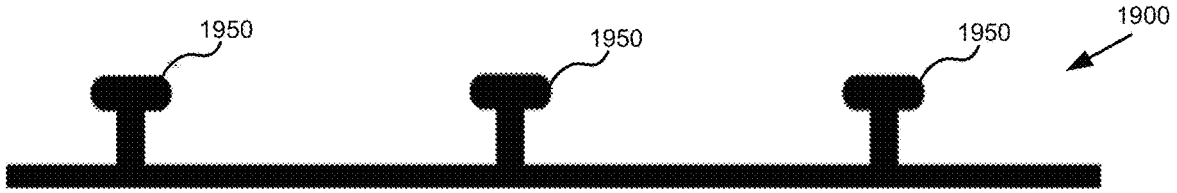
FIG. 41 display an alternative exemplary bridge portion with a T-shaped truss profile.
Figure 42:
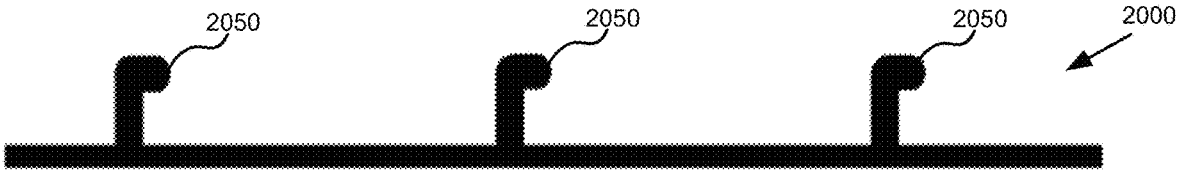
FIG. 42 display an alternative exemplary bridge portion with an upside down L-shaped truss profile.
Figure 43:
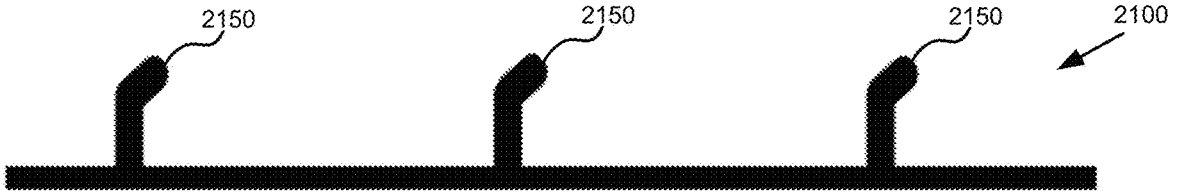
FIG. 43 display an alternative exemplary bridge portion with an upper truss portion which is slanted from the main body of the truss.
Figure 44:
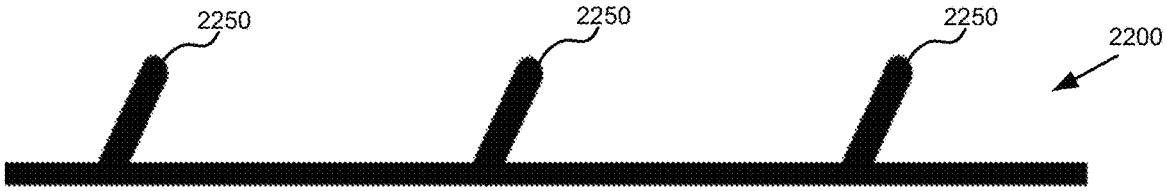
FIG. 44 display an alternative exemplary bridge portion with each truss having a slanted profile.

FIG. 40 is a partial side view of a portion of another embodiment of an exemplary gutter guard device with a non-uniform height truss 1880. The truss 1880 has a first end 1856 and a second end 1857. A height 1858 of the truss 1880 at its first end 1856 is greater in dimension than a height 1859 of the truss 1880 at the second end 1857. The truss 1880 has a sloped profile from one end to the other. It will be appreciated that trusses on the same device can have varying profile dimensions and shapes as illustrated in the other embodiments, as well as having a non-linear slope (e.g., multi-angled, curved, etc.).

FIGS. 41, 42, 43 and 44 display partial profile views of bridge portions of alternative exemplary embodiments of gutter guard devices 1900, 2000, 2100 and 2200, respectively. The devices 1900, 2000, 2100 and 2200 are very similar to the device 100, however, each of them includes trusses with different profile shapes. Particularly, device 1900 includes a plurality of trusses 1950 having a T-shaped profile. Device 2000 includes a plurality of trusses 2050 having an upside down or inverted L-shaped profile. Device 2100 includes a plurality of trusses 2150 with an upper portion which is slanted from the main body of the truss. Device 2200 includes a plurality of trusses 2250 all having a slanted profile (at an angle less than 90 degrees to the decking of the bridge portion).

It will be appreciated that the trusses in various embodiments of the present disclosure can have a variety of contour shapes along their lateral length from the front to back of the gutter guard device other than being perpendicular, somewhat perpendicular or angled.

Figure 45:
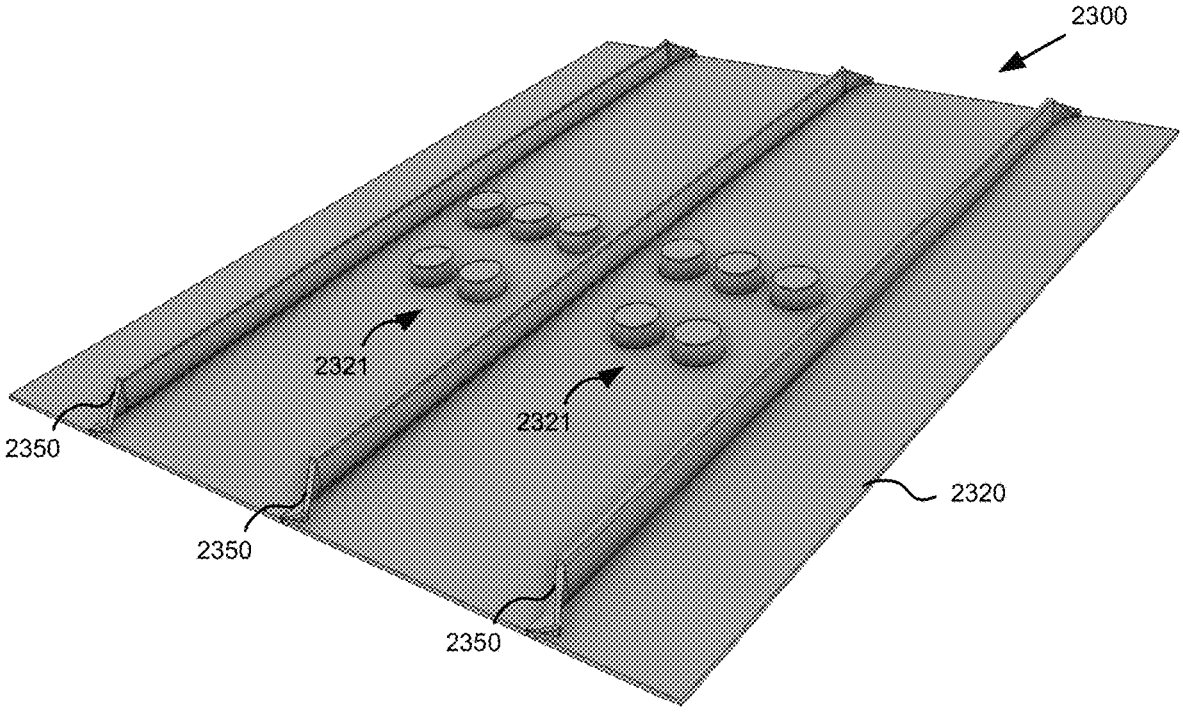
FIG. 45 displays a perspective view of another embodiment of an exemplary bridge portion.

FIG. 45 displays a perspective view of another embodiment of an exemplary gutter guard device 2300. The device 2300 has similar characteristics to device 100, having a bridge portion 2320 and at least one truss 2350. For illustration purposes orifices in the bridge portion 2320 are not illustrated. A principal difference of device 2300 from device 100 is that it includes at least one barricade 2321, shown here with elevated sections. The barricade(s) 2321 can be formed directly in the bridge portion 2320. It will be appreciated that the barricade(s) 2321 can be located on the top surface or bottom surface of the bridge portion 2320. In this exemplary embodiment the barricade(s) 2321 are disposed on the top surface. As shown in this Fig., this particular embodiment has barricade(s) 2321 that can be described as a plurality of bumps raised from the bridge portion 2320. The size, arrangement, shape, height, positioning and number of barricade(s) may be varied, according to design preference.

It will be appreciated that the barricade 2320 can be an impression formed directly in the material of the bridge portion 2320 and/or a separate material affixed to the bridge portion 2320 to produce a pronounced change in the height of the bridge portion 2320. The height change is sufficient enough to produce a debris drying effect; and the shapes of the barricades can serve to alter debris and/or water flow over the bridge portion.

It will be appreciated that having a barricade-like structure on the top surface protruding away from the gutter opening when in use (i.e. bumped), will aide in preventing debris from collecting on the device 2300. Particularly, leaves can often be wet and when wet will not readily move off the device 2300. Having barricade(s) 2321 will allow a leaf, or the like to rest against the barricade-like structure. In this arrangement, the leaf will tend to dry out quicker because a spacing or gap will be provided under the leaf. Being drier will allow the wind to blow the leave off the gutter. Further, with a gap below the leaf, wind can pass below the leaf, enabling faster drying of the leaf. Still further, the gap allows wind to travel below the leaf and this increases the likelihood the leaf will be blown off of the device 2300.

Figure 46:
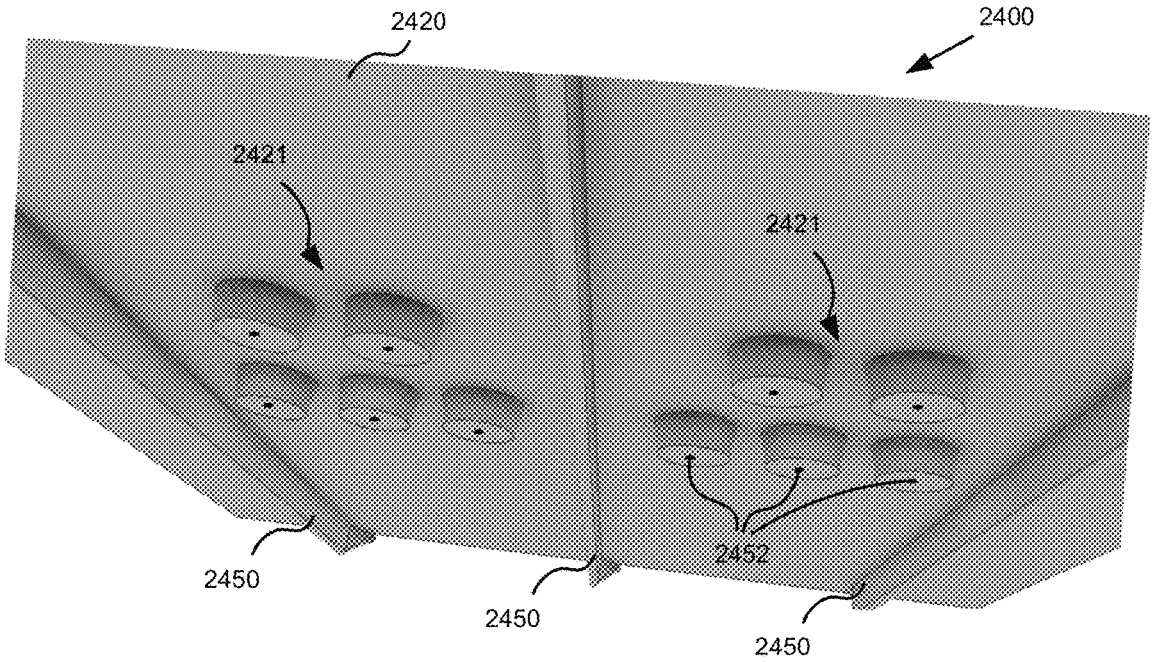
FIG. 46 displays an underside portion of another embodiment of an exemplary bridge portion.
Figure 47:
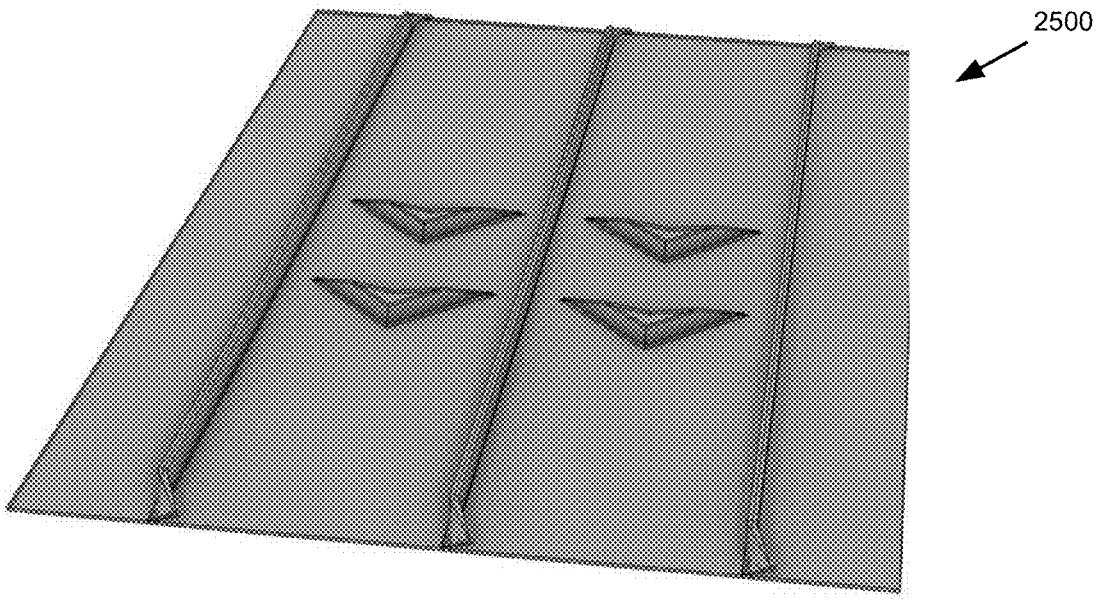
FIG. 47 displays a portion of an alternative embodiment of an exemplary bridge portion.
Figure 48:
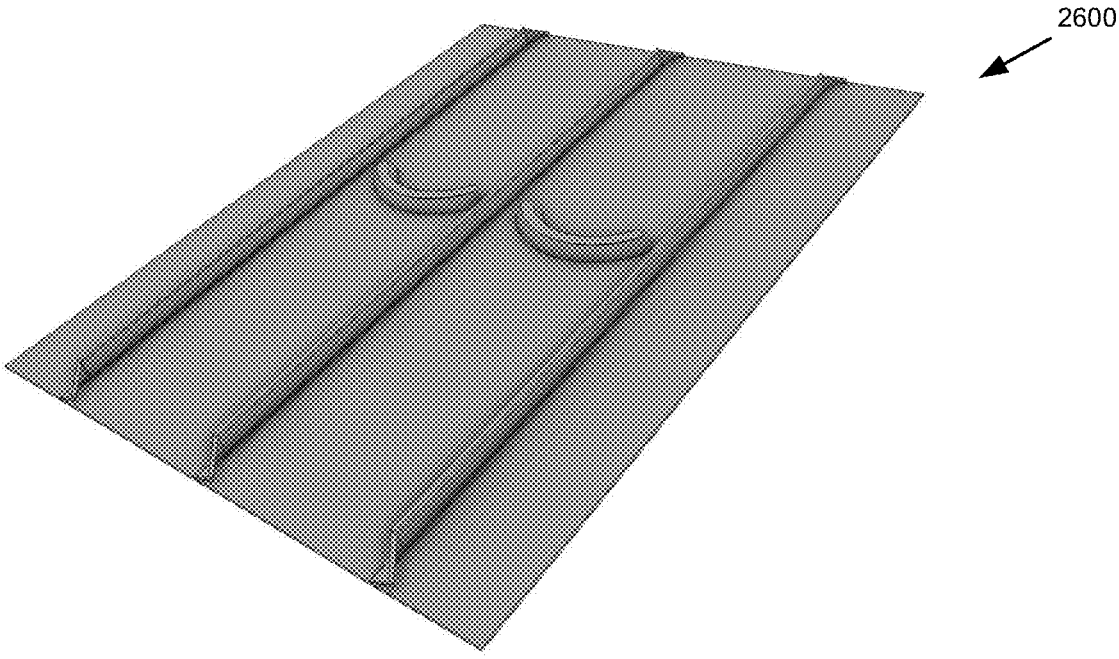
FIG. 48 displays a portion of another alternative embodiment of an exemplary bridge portion.
Figure 49:
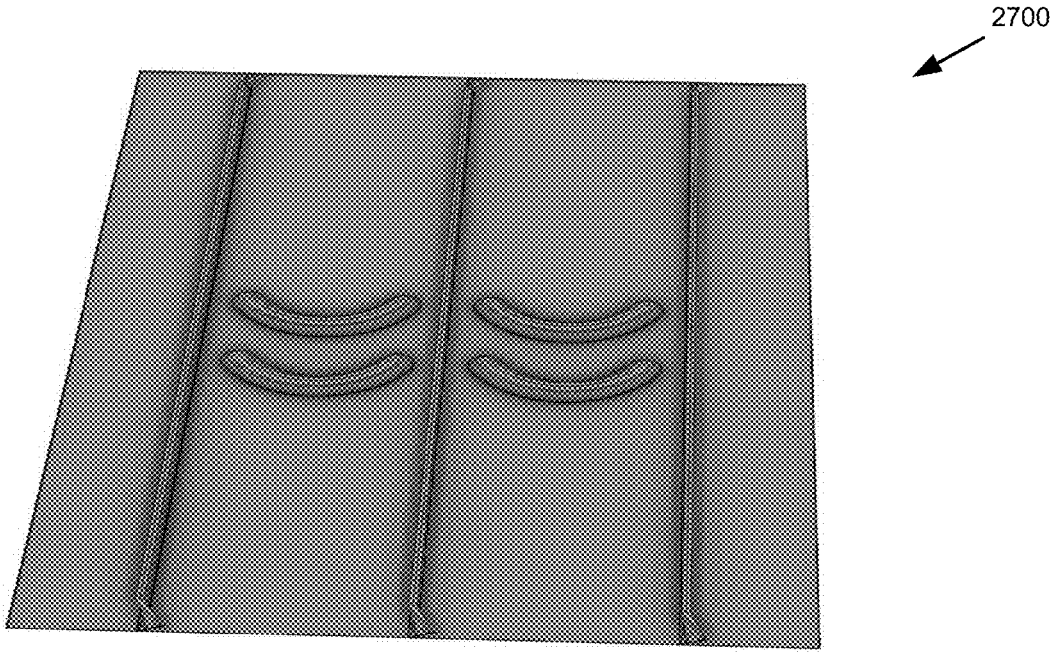
FIG. 49 displays a portion of another alternative embodiment of an exemplary bridge portion.
Figure 50:
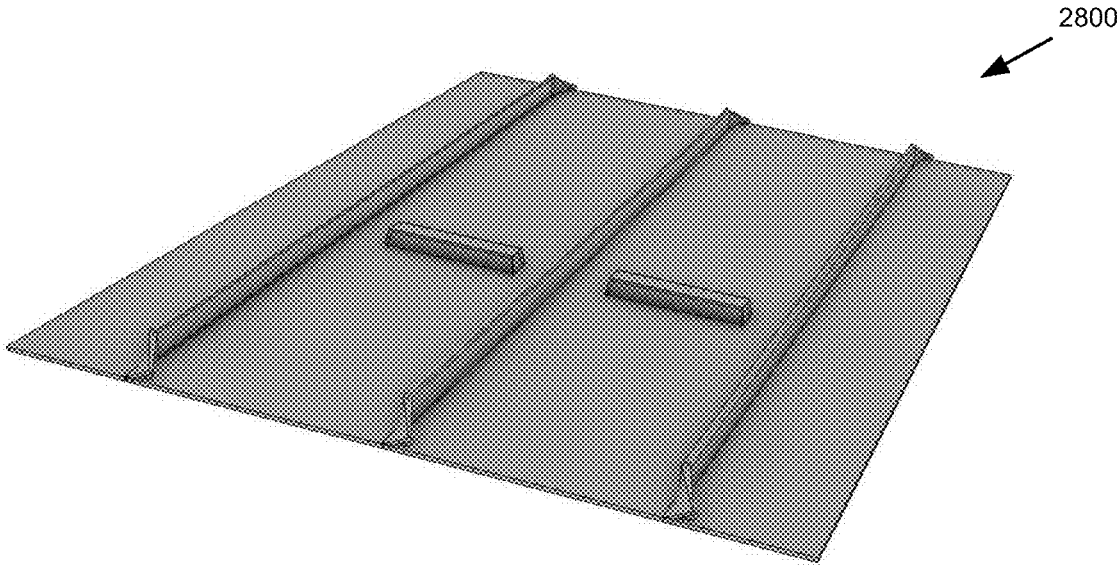
FIG. 50 displays a portion of another alternative embodiment of an exemplary bridge portion.
Figure 51:
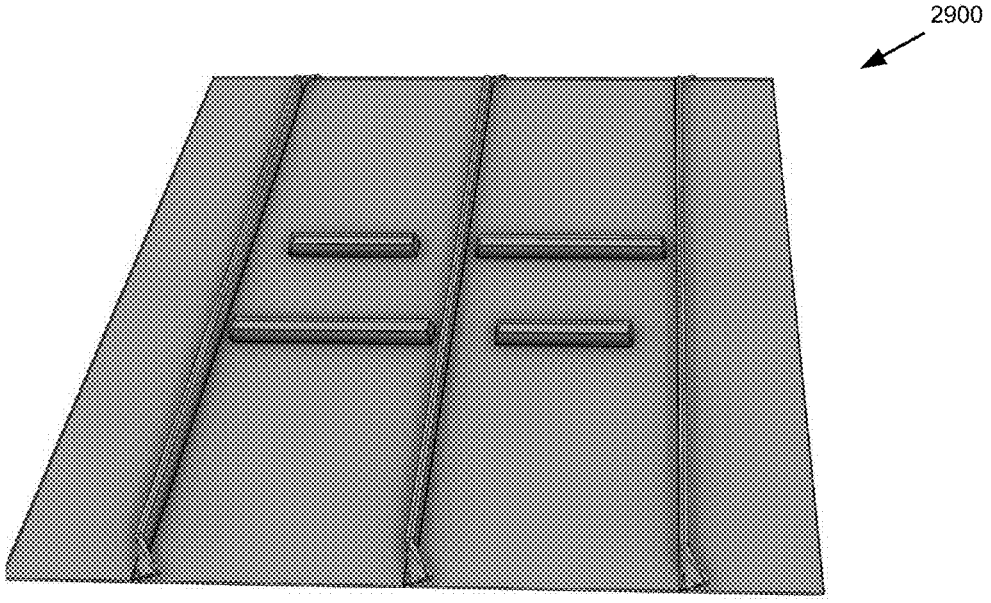
FIG. 51 displays a portion of another alternative embodiment of an exemplary bridge portion.
Figure 52:
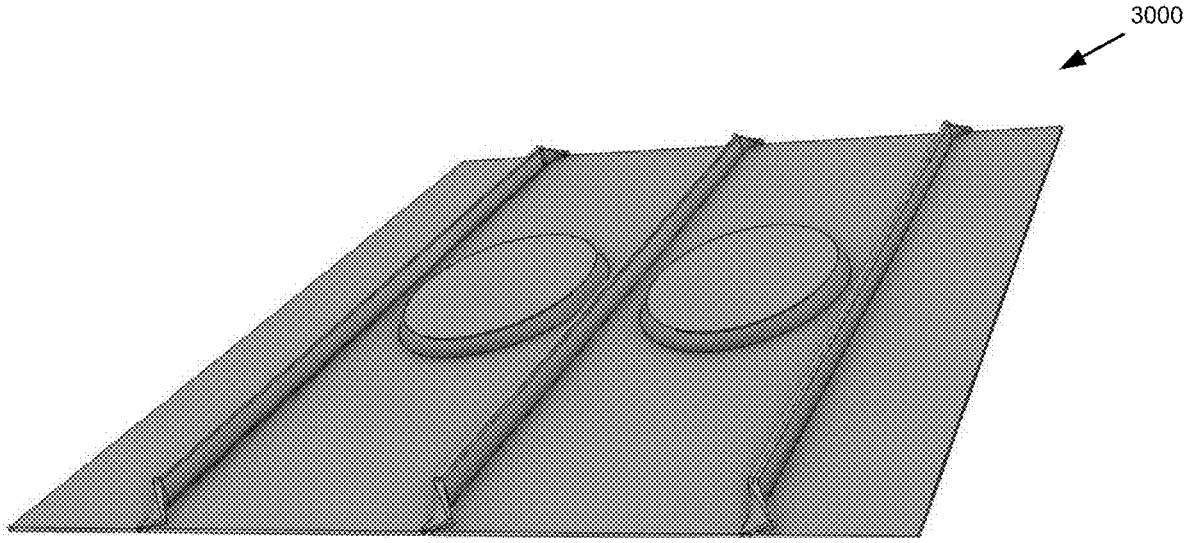
FIG. 52 displays a portion of another alternative embodiment of an exemplary bridge portion.
Figure 53:
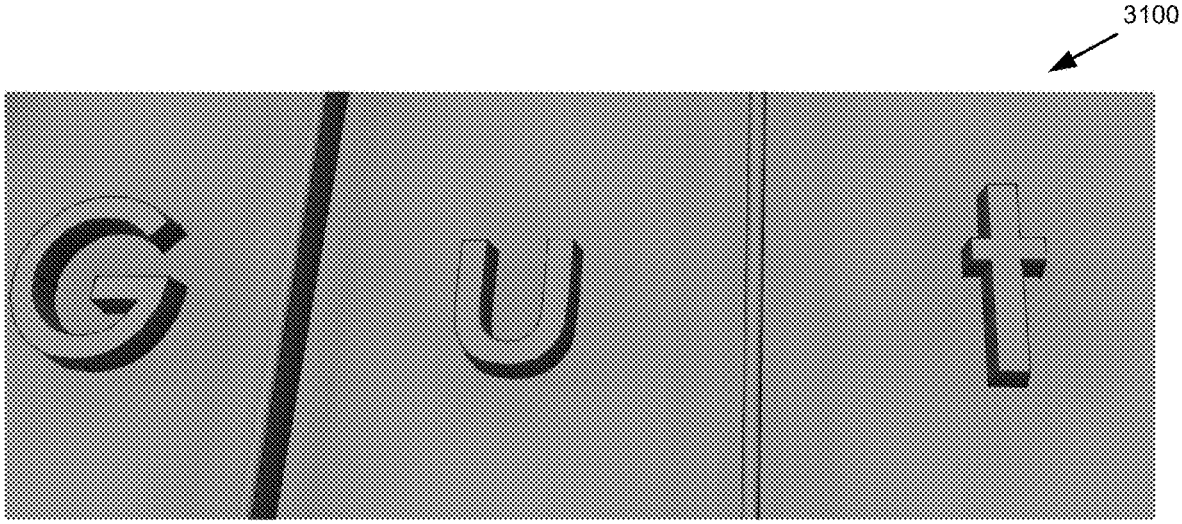
FIG. 53 displays a portion of another alternative embodiment of an exemplary bridge portion.
Figure 54:
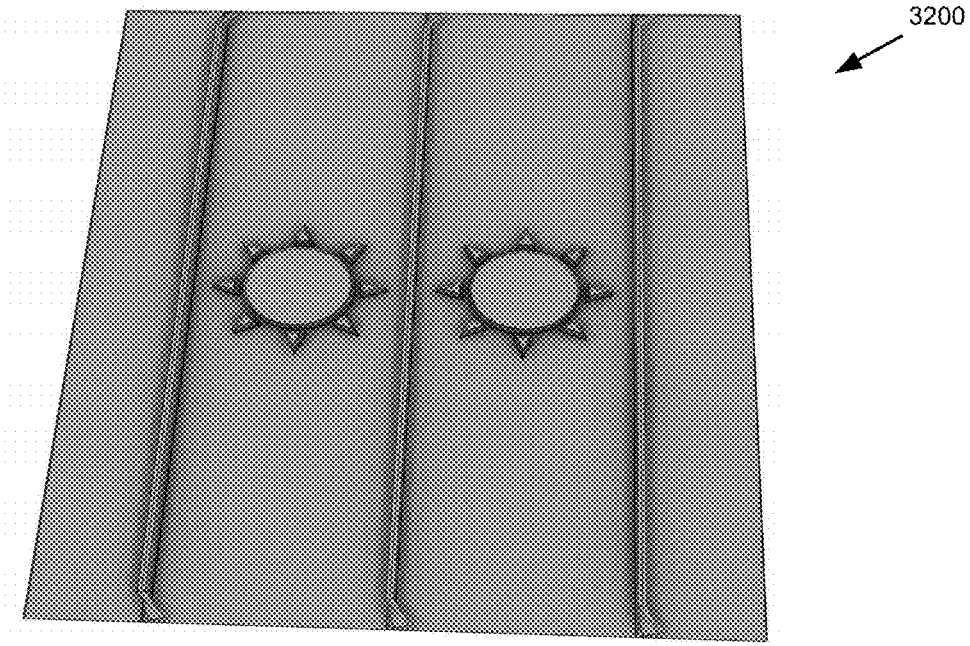
FIG. 54 displays a portion of another alternative embodiment of an exemplary bridge portion.

FIG. 46 displays an underside portion of a bridge portion of another embodiment of gutter guard device 2400. The device 2400 has a bridge portion 2420, at least one underside truss 2450 and at least one barricade 2421. For illustration purposes orifices in the bridge portion 2420 are not illustrated. The device 2400 differs from device 2300 in that barricade(s) 2421 is recessed and the trusses 2450 are formed in the bottom of the device 2300. Particularly, the barricade(s) 2421 extends from the bottom surface of the bridge portion 2421 toward the gutter opening when the device 2400 is in use. The barricade(s) 2421 also include at least one orifice 2452 disposed at the bottom of the barricade(s) 2421. The barricade orifice 2452 is presumed here to be larger than the inherent orifices found in the bridge material. With the barricade(s) 2421 being recessed, rainwater will flow into the barricade(s) 2421 and then drain through the orifice 2452 and into the gutter opening when the device 2400 is in use. It will be appreciated that in other exemplary embodiments there may be multiple recessed barricades as well as raised barricades in combination with the recessed barricades. It will further be appreciated that in other exemplary embodiments, each recessed barricade can include multiple orifices. Moreover, while the trusses 2450 are shown as being on an underside of the bridge portion 2420, it is understood that they may be disposed on the top of the bridge portion 2420.

The size, arrangement, shape, height, positioning and number of barricade(s) may be varied, according to design preference. It will be appreciated that in other various exemplary embodiments, recesses barricades and bump barricades can be combined on the same device.

FIGS. 47, 48, 49, 50, 51, 52, 53 and 54 display portions of alternative embodiments of gutter guard devices 2500, 2600, 2700, 2800, 2900, 3000, 3100 and 3200, respectively. These devices share similar attributes to devices 2300 and 2400, wherein the barricade-like structures are shown in various shapes, configurations, groupings, elevations, designs, and so forth. It is understood that the features of these Figs. are self-explanatory and serve to demonstrate a small sample set of the limitless modifications and changes that one of ordinary skill in the art may apply, without departing from the spirit and scope of this disclosure.

Figure 55:
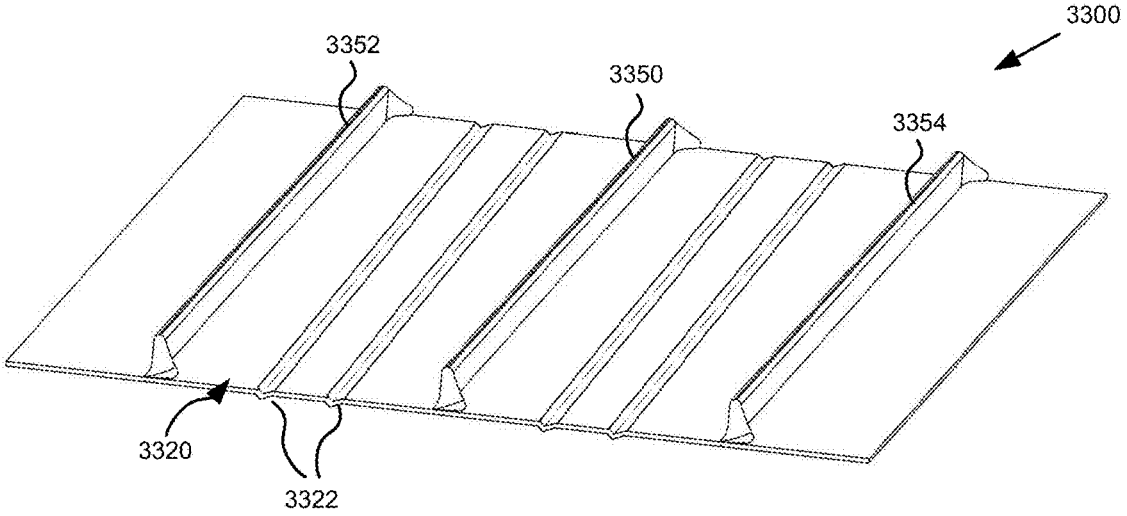
FIG. 55 displays a portion of another embodiment of an exemplary bridge portion with grooves.
Figure 56:
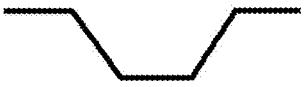
FIG. 56 displays a side profile view of a half hexagon groove for use with the embodiment of FIG. 55.
Figure 57:
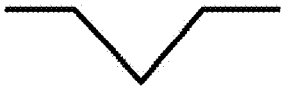
FIG. 57 displays a side profile view of a triangular groove for use with the embodiment of FIG. 55.
Figure 58:
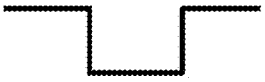
FIG. 58 displays a side profile view of a box groove for use with the embodiment of FIG. 55.
Figure 59:
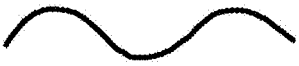
FIG. 59 displays a side profile view of a sinusoidal groove for use with the embodiment of FIG. 55.
Figure 60:
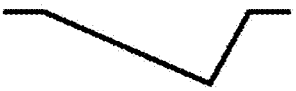
FIG. 60 displays a side profile view of an off center groove for use with the embodiment of FIG. 55.
Figure 61:
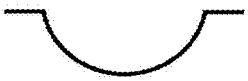
FIG. 61 displays a side profile view of a dip groove for use with the embodiment of FIG. 55.

FIG. 55 displays a portion of another embodiment of an exemplary gutter guard device 3300. The device 3300 has similar characteristics to device 100, having a bridge portion 3320 and trusses 3350, 3352 and 3354. For purposed of clarity, other features of the device 3300 such as the trough portion, gutter attachment portion and the roof attachment portion are not illustrated in this Fig. Further, orifices in the bridge portion 3320 are not shown for purposes of clarity. One of the ways that device 3300 differs from device 100 is that device 3300 further includes at least one groove 3322. While the term groove suggests a valley-like or recessed channel-like feature, it is understood that it may also apply to the reverse (or flipped) shape having a ridge-like or elevated channel-like feature. The applicable interpretation being evident in the context being described. One or more of these grooves 3322 can be disposed in the planar surface of the bridge portion 3320 and further disposed between adjacent trusses 3350, 3352 and 3354. The grooves 3322 can be disposed across the entire length of the bridge portion 3320. However, it will be appreciated that the grooves 3322 may in other embodiments extend only a portion of the bridge portion 3320. Further, the adjacent grooves can be parallel to one another. However, it will be appreciated that adjacent grooves in other embodiments, can be non-parallel. The grooves 3322 can provide additional support to the device 3300. The grooves 3322 may be disposed at about 90 degrees to a rear edge of the bridge portion 3320. However, it should be appreciated that the grooves 3322 can, in other embodiments, be disposed at other angles. Further, while these grooves 3322 are shown recessed down in the bridge portion 3320, it will be appreciated that the grooves 3322 can be bumped up (e.g., reversed) from the surface of the bridge portion 3320.

In some embodiments, it is understood that the size, type, shape, etc. of the grooves 3322 themselves may provide sufficient enough support to mitigate the need for one or more of the trusses 3352, even to a point where no trusses may be needed for support. Therefore, it is understood that a multi-grooved bridge section will affect the number of trusses needed in such a device and a non-truss embodiment can be developed with an appropriately multi-grooved bridge.

FIGS. 56, 57, 58, 59, 60, and 61 display side profile views of various examples of profile shapes that the grooves may have for alternate embodiments of the exemplary device 3300. Specifically, half hexagon, triangular, box, sinusoidal, off center, and dip respectively. It will be appreciated, that these shapes are only a small sample of other possible shapes that may be utilized. Therefore, various modifications and changes to the shapes, sizes, and orientations thereof are understood to be within the spirit and scope of this disclosure.

Figure 62:
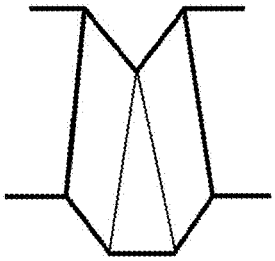
FIG. 62 shows a groove profile shape transition along its length from a half hexagon profile to a triangle profile.
Figure 63:
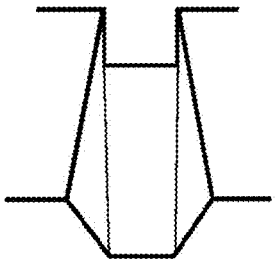
FIG. 63 shows a groove profile shape transition along its length from a half hexagon profile to a box profile.
Figure 64:
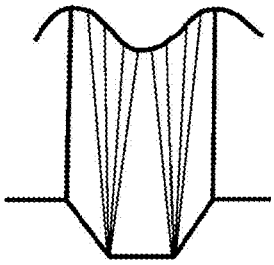
FIG. 64 shows a groove profile shape transition along its length from a half hexagon profile to a sinusoidal profile.
Figure 65:
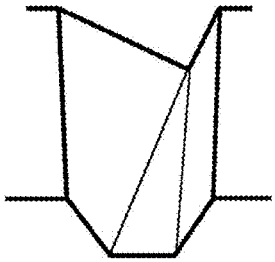
FIG. 65 shows a groove profile shape transition along its length from a half hexagon profile to an off-center profile.
Figure 66:
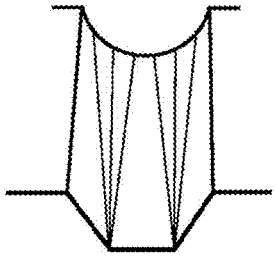
FIG. 66 shows a groove profile shape transition along its length from a half hexagon profile to a dip profile.

FIGS. 62, 63, 64, 65, and 66 display front perspective views of various examples of profiles that the grooves may have for alternative embodiments of the exemplary device 3300. Particularly, these profiles change their geometry along the length of the groove. FIG. 62 shows a groove profile shape transition along its length from a half hexagon profile to a triangle profile. FIG. 63 shows a groove profile shape transition along its length from a half hexagon profile to a box profile. FIG. 64 shows a groove profile shape transition along its length from a half hexagon profile to a sinusoidal profile. FIG. 65 shows a groove profile shape transition along its length from a half hexagon profile to an off-center profile. FIG. 66 shows a groove profile shape transition along its length from a half hexagon profile to a dip profile.

As stated above, the above set of examples demonstrate that multiple types of modifications and changes can be made to the grooves. Therefore, other shapes, sizes, and orientations, reversals, flips, thereof are understood to be within the spirit and scope of this disclosure.

Figure 67:
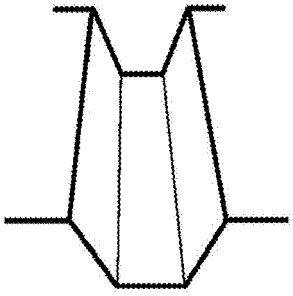
FIG. 67 shows a groove profile shape transition along its length from a half hexagon profile to a smaller dimension half hexagon profile.
Figure 68:
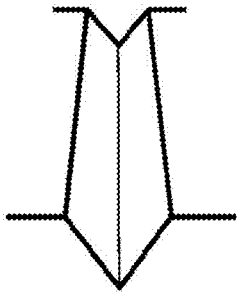
FIG. 68 shows a groove profile shape transition along its length from a large V profile to a smaller V profile.
Figure 69:
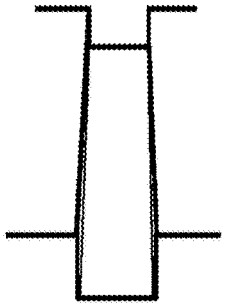
FIG. 69 shows a groove profile shape transition along its length from a large box to a small box profile.
Figure 70:
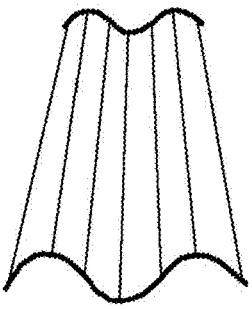
FIG. 70 shows a groove profile shape transition along its length from a large sinusoidal to a small sinusoidal profile.
Figure 71:
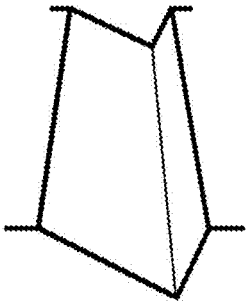
FIG. 71 shows a groove profile shape transition along its length from a large off-center profile to a small off-center profile.
Figure 72:
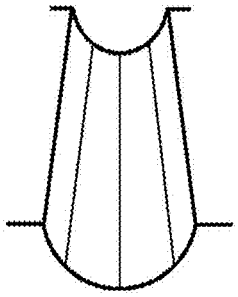
FIG. 72 shows a groove profile shape transition along its length from a large dome profile to a small dip profile.

FIGS. 67, 68, 69, 70, 71, and 72 display front perspective views of various examples of profiles that the grooves 3322 may have for alternative embodiments of the exemplary device 3300. Particularly, these profiles change their size along the length of the groove 3322. FIG. 67 shows a groove profile shape transition along its length from a half hexagon profile to a smaller dimension half hexagon profile. FIG. 68 shows a groove profile shape transition along its length from a large V profile to a smaller V profile. FIG. 69 shows a groove profile shape transition along its length from a large box to a small box profile. FIG. 70 shows a groove profile shape transition along its length from a large sinusoidal to a small sinusoidal profile. FIG. 71 shows a groove profile shape transition along its length from a large off-center profile to a small off-center profile. FIG. 72 shows a groove profile shape transition along its length from a large dome profile to a small dip profile.

Figure 73:
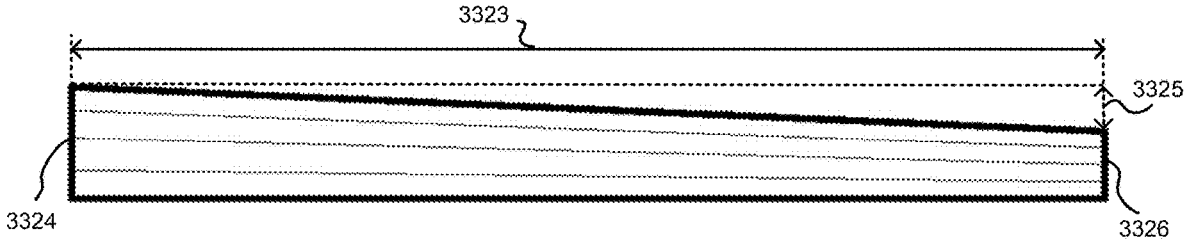
FIG. 73 shows a side view of another feature for groove embodiments with slanting/diminishing profile.

FIG. 73 shows a side view of another feature for groove embodiments that may be implemented. Here, it can be seen that the lateral apex 3323 of the diminishing regular or irregular groove to slant down from back edge 3324 to the front edge 3326. The lateral apex 3323 reduces the height of the groove by a dimension 3325. A benefit of diminishing regular or irregular grooves, perpendicular or non-perpendicular to the longitudinal front axes of the gutter to the back roofline (when the device is in use), is it enables debris to more readily slide off the device.

Figure 74:
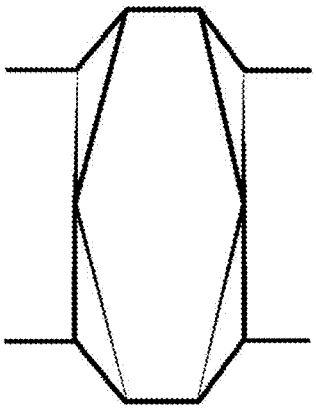
FIG. 74 shows a groove profile shape transition along its length from a half hexagon profile to nothing and then back to a half hexagon profile.
Figure 75:
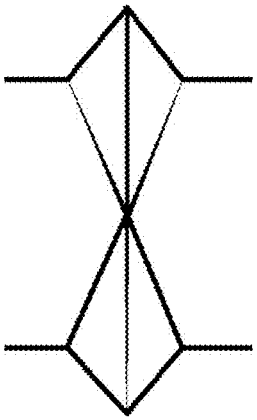
FIG. 75 shows a groove profile shape transition along its length from a V profile to virtually nothing and back to a V profile.
Figure 76:
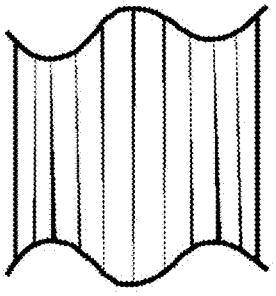
FIG. 76 shows a groove profile shape transition along its length from a sinusoidal to virtually nothing and back to sinusoidal.
Figure 77:
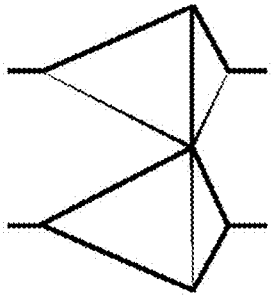
FIG. 77 shows a groove profile shape transition along its length from an off-center profile to virtually nothing and back to an off-center profile.
Figure 78:
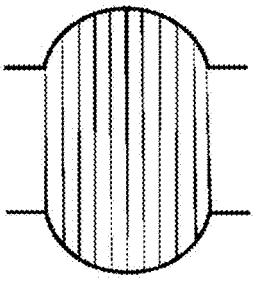
FIG. 78 shows a groove profile shape transition along its length from a recessed dip profile to virtually nothing and back to a bumped dip profile.

FIGS. 74, 75, 76, 77, and 78 and display various examples of geometries that the grooves 3322 may have for alternate embodiments of the exemplary device 3300. Most of the shapes of the grooves are considered as irregular or geometric, some having a changing profile along the length of the groove. For example, FIG. 74 shows a groove profile shape transition along its length from a half hexagon at one end profile to nothing (i.e., planar) in the middle and then back to a half hexagon profile at the opposing end. FIG. 75 shows a groove profile shape transition along its length from a V profile to virtually nothing and back to a V profile. FIG. 76 shows a groove profile shape transition along its length from a sinusoidal to virtually nothing and back to sinusoidal. FIG. 77 shows a groove profile shape transition along its length from an off-center profile to virtually nothing and back to an off-center profile. FIG. 78 shows a groove profile shape transition along its length from a recessed dip profile to virtually nothing and then to a bumped dip profile. It should be noted that while the above Figs. illustrate a "symmetry" in the transitions of the groove shapes or geometry, non-symmetric configurations may be implemented.

Figure 79:
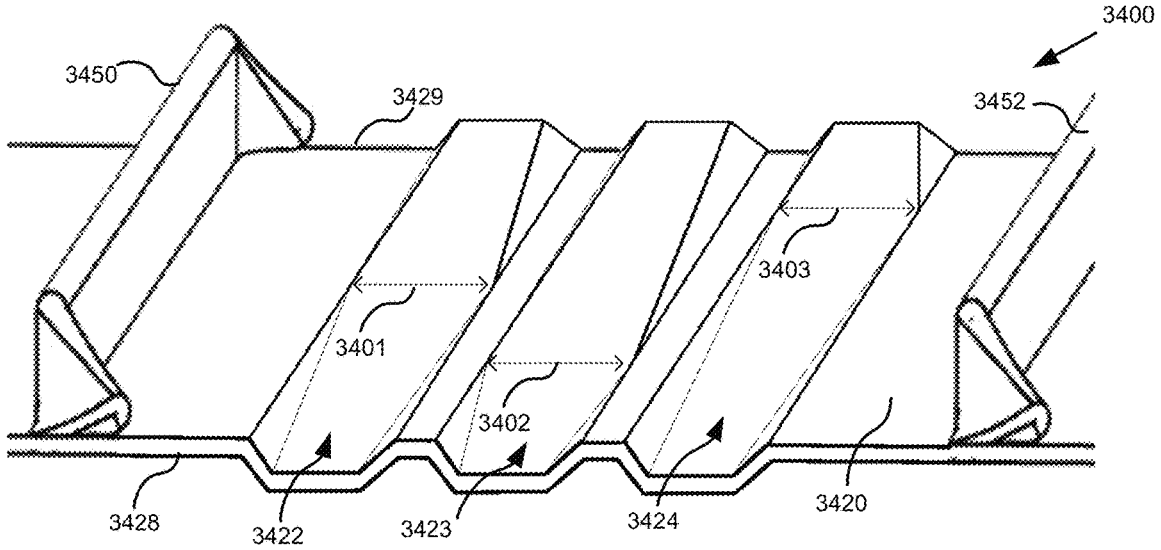
FIG. 79 displays a front perspective view of a portion of another embodiment of an exemplary bridge portion with a plurality of reversed half hexagonal transition grooves.

FIG. 79 displays a partial front perspective view of a portion of another embodiment of an exemplary gutter guard device 3400. The exemplary device 3400 is analogous to device 3300 having a bridge portion 3420, at least one truss 3450 and 3352. For purposed of clarity, other features of the device 3400 such as the trough portion, gutter attachment portion and the roof attachment portion are not illustrated in this figure. Further, orifices in the bridge portion 3420 are not shown for purposes of clarity.

Device 3400 also like device 3300 includes at least one groove in the bridge portion 3420. The at least one groove is illustrated here as three grooves 3422, 3423 and 3424. Each of the grooves are half hexagon grooves where a portion of the respective groove is disposed recessed on an underside of the bridge portion 3420 and another portion of the respective groove is disposed bumped "up" on the top side of the bridge portion 3420.

Figure 80:
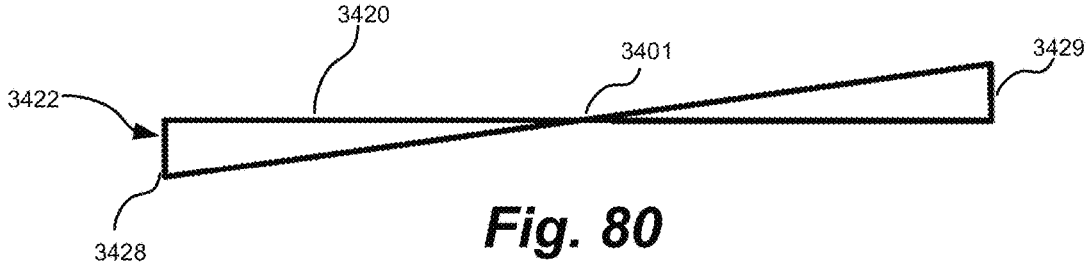
FIG. 80 shows a side profile of a first groove of the embodiment shown in FIG. 79.
Figure 81:
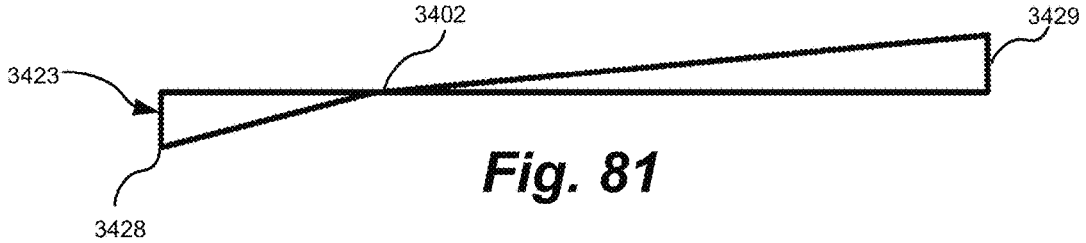
FIG. 81 shows a side profile of a second groove of the embodiment shown in FIG. 79.
Figure 82:
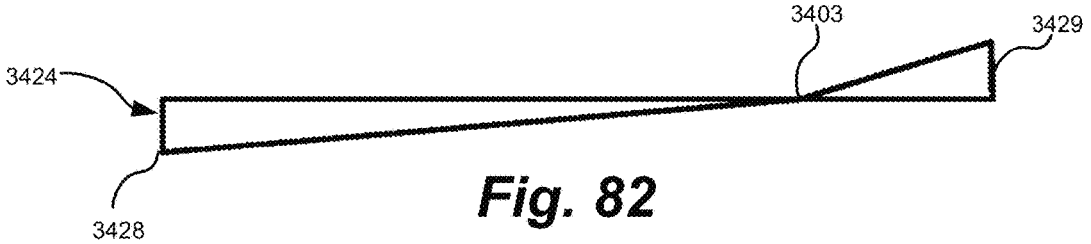
FIG. 82 shows a side profile of a third groove of the embodiment shown in FIG. 79.

FIGS. 80, 81 and 82 show side profiles of the just each of the grooves 3422, 3423 and 3424, respectively. The grooves are illustrated here as having a half hexagon profile shape, understanding that other analogous shapes may be used. FIG. 80 shows a side profile of groove 3422. The groove 3422 is an irregular groove wherein at a front end 3428 of the bridge portion 3420, the groove 3422 is disposed on the underside of the bridge portion 3420. The groove 3422 at a back end 3429 of the bridge portion 3420 is disposed on the top side of the bridge portion 3420. The top side is an opposing side of the underside. The groove 3422 has a transition 3401 along its length, wherein the groove 3422 transitions from the underside to the top side. The transition 3401 which is about half-way along the length of groove 3422 and along the x-axis.

FIG. 81 shows a side profile of groove 3423. The groove 3423 is an irregular groove wherein at the front end 3428 of the bridge portion 3420, the groove 3423 is disposed on the underside of the bridge portion 3420. The groove 3423 at the back end 3429 of the bridge portion is disposed on the top side of the bridge portion 3420. The groove 3423 has a transition point 3402 along its length, wherein the groove 3423 transitions from the underside to the top side. The transition 3402 is displaced from the half-way point along the length of groove 3423. The transition 3402 is disposed along the length of the groove 3423 closer to the front end 3428 than the back end 3429.

FIG. 82 shows a side profile of groove 3424. The groove 3424 is an irregular groove wherein at the front end 3428 of the bridge portion 3420, the groove 3424 is disposed on the underside of the bridge portion 3420. The groove 3424 at the back end 3429 of the bridge portion 3420 is disposed on the top side of the bridge portion 3420. The groove 3424 has a transition point 3403 along its length, wherein the groove 3424 transitions from the underside to the top side. The transition 3403 is displaced from the half-way point along the length of groove 3424. The transition 3403 is disposed along the length of the groove 3424 closer to the back end 3429 than the front end 3428.

FIG. 83 displays a partial front perspective view of a portion another embodiment of an exemplary gutter guard device 3500. The exemplary device 3500 is analogous to device 3400 having a bridge portion 3520 and at least one truss. For purposed of clarity, other features of the device 3500 such as the trough portion, gutter attachment portion, the at least one truss, and the roof attachment portion are not illustrated in this Fig. Further, orifices in the bridge portion 3520 are not shown for purposes of clarity. The device 3500 includes at least on groove in the bridge portion 3520. In this embodiment, the at least one groove is shown as three grooves 3522, 3523 and 3524. These grooves are irregular in their respective shapes. The grooves 3522, 3523 and 3524 are formed above, below and above the bridge portion 3520, respectively. Each of the grooves 3522, 3523 and 3524 has a planar apex surface 3525, 3526, and 3527, respectively. The spacing between these irregular grooves can be varied in other embodiments. For illustration, these grooves can be bifurcated, as shown with groove 3523. The groove 3523 has a bottom chord 3528, which bifurcates to two secondary chords 3529 and 3521. It should be appreciated that while the illustrated groove shapes appear to be linearly shaped, they may be altered to form non-linear transitions, oriented in different directions, and so forth.

Figure 89:
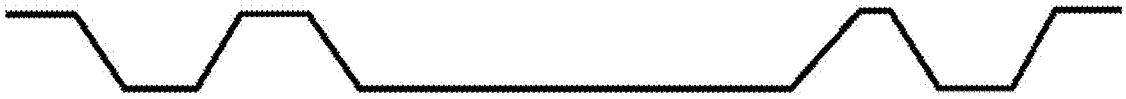
FIG. 89 illustrates an exemplary bridge portion having irregular grooves with varying groove widths.
Figure 90:
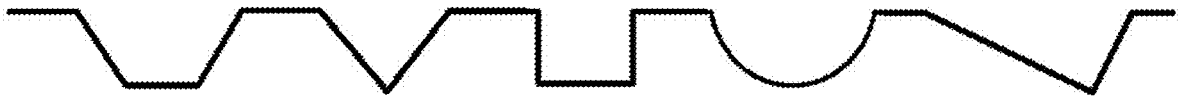
FIG. 90 illustrates an exemplary bridge portion having irregular grooves with varying groove shapes.
Figure 91:
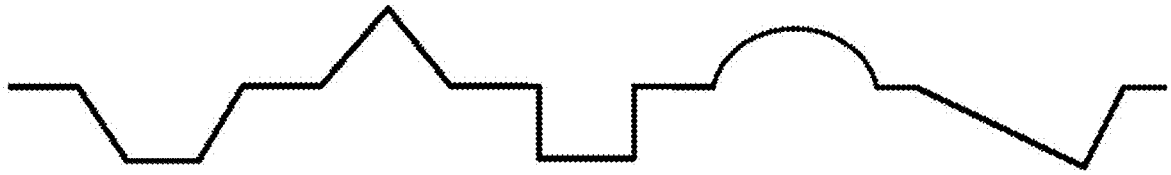
FIG. 91 illustrates an exemplary bridge portion having irregular grooves with cross plane varying groove shapes.
Figure 92:
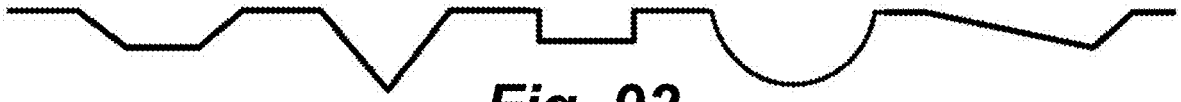
FIG. 92 illustrates an exemplary bridge portion having irregular grooves with varying groove shape and groove heights.
Figure 93:
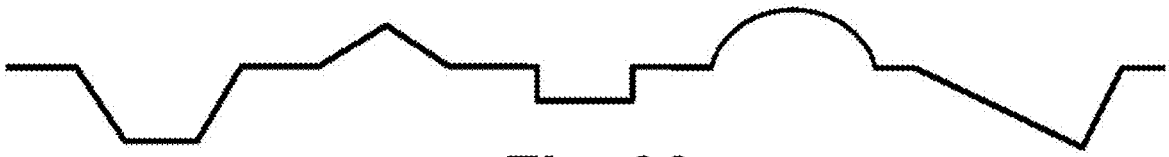
FIG. 93 illustrates an exemplary bridge portion having irregular grooves with cross plane varying groove shapes and groove heights.

FIGS. 84, 85, 86, 87, 88, 89, 90, 91, 92, and 93 display front profile views of examples of various groove arrangements in alternative embodiments of the bridge portion of the exemplary devices. As can be seen, some profiles appear as a train of angled line segments. For example, FIG. 84 illustrates a bridge portion having a plurality of alternating irregular grooves. FIG. 85 illustrates a bridge portion having a plurality of"downward" irregular grooves. FIG. 86 illustrates a bridge portion having a plurality of "upward" irregular grooves. FIG. 87 illustrates a bridge portion having a plurality of cross plane irregular grooves. FIG. 88 illustrates a bridge portion having a plurality of irregular grooves with varying groove heights/depths. FIG. 89 illustrates a bridge portion having irregular grooves with varying groove widths. FIG. 90 illustrates a bridge portion having irregular grooves with varying groove shapes. FIG. 91 illustrates a bridge portion having irregular grooves with cross plane varying groove shapes. FIG. 92 illustrates a bridge portion having irregular grooves with varying groove shape and groove heights/depths. FIG. 93 illustrates a bridge portion having irregular grooves with cross plane varying groove shapes and groove heights/depths.

Figure 94:
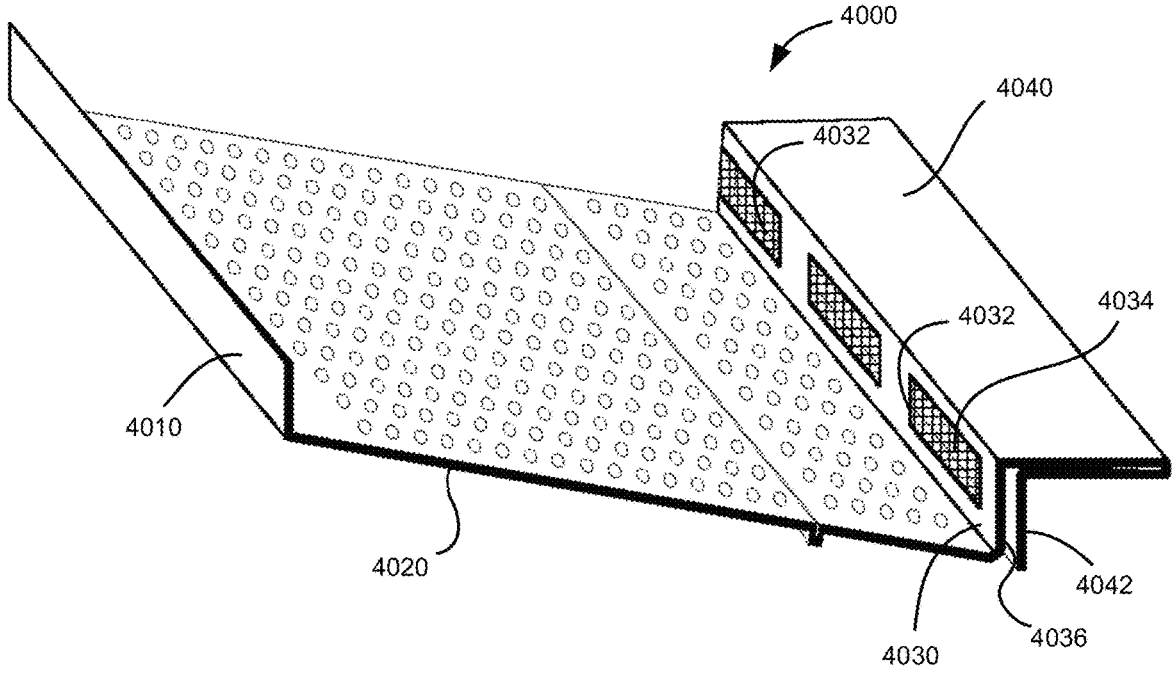
FIG. 94 illustrates a partial perspective view of an exemplary device having a trough portion having window openings.
Figure 95:
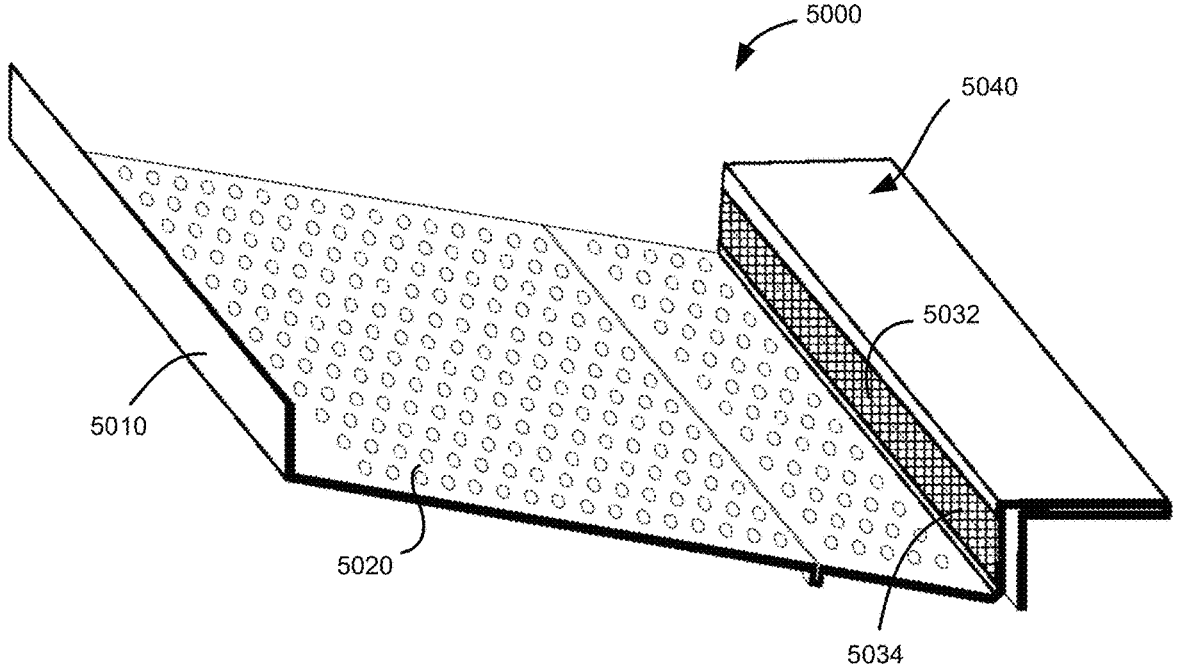
FIG. 95 illustrates a partial perspective view of an exemplary device having a trough portion having an alternatively shaped window opening.

FIGS. 94 and 95 are partial top perspective views of a devices 4000 and 5000, which have alternative trough portion embodiments for use in the exemplary device(s). Note, for purposes of clarity, the trusses of these devices are not shown. FIG. 94 shows the device 4000 having a roof attachment portion 4010, a bridge portion 4020, a trough portion 4030 and a gutter attachment portion 4040. It will be appreciated that in other embodiments, the "unshown" trusses may be optional and not needed. Trough portion 4030 includes a plurality of window openings 4032. The window openings 4032 are shown as rectangular in shape, however, it will be appreciated that other shapes could be utilized, such as but not limited to ovals, circles and the like. The trough portion 4030 further includes a plurality of screens 4034. The screens 4034 are disposed on an interior surface 4036 of the trough portion 4030. The screens 4034 are disposed directly adjacent each respective window and may be at least the same dimension of the corresponding window. The windows can be of different dimensions. The screens 4034 may be made of a stainless-steel micromesh. However, it will be appreciated that other materials can be used. The screens are attached with any conventional means or fasteners, such as glue, rivets, and the like. The gutter attachment portion 4040 includes a water diverter member 4042 disposed on the underside of the gutter attachment portion 4040. The water diverter is disposed a slight distance behind the windows such when in use, as water goes through the windows 4032 and screens 4034, the water will hit the water diverter 4042 and be directed toward the gutter opening.

FIG. 95 shows and example of a different shape for the window openings 5032. In this embodiment, device 5000 has a roof attachment portion 5010, a bridge portion 5020, a trough portion 5030 and a gutter attachment portion 5040. However, in this embodiment, the trough portion 5030 includes a window opening 5032 that has an elongated rectangular shape with a corresponding elongated rectangular shaped mesh 5034.

While this invention has been described in conjunction with the specific embodiments outlined above, it is evident that many alternatives, modifications and variations will be apparent to those skilled in the art. Accordingly, the described embodiments of the invention, as set forth above, are intended to be illustrative, not limiting. Thus, various changes and combinations thereof may be made without departing from the spirit and scope of this invention. When structures are identified as a means to perform a function, the identification is intended to include all structures, which can perform the function specified.

What is claimed is:

1. A single piece gutter guard device, comprising:

a bridge member composed of a decking material having sections with a plurality of orifices, the bridge member having a roof side and opposing gutter lip side;

at least one truss formed from a fold in the bridge member, continuously spanning a majority of a top surface of the bridge member, the at least one truss having a height and a width, wherein the height is greater than the width, wherein a bottom surface of the bridge member is substantially continuous across a bottom width of the at least one truss;

a roof attachment member formed from the roof side; and a gutter attachment member formed from the gutter lip side, wherein the roof attachment member, the bridge member and the gutter attachment member are formed from a unitary single piece of material and the gutter guard device is configured to be self-supporting due to support from the at least one truss.

2. The gutter guard device of claim 1, wherein the at least one truss is a plurality of trusses.

3. The gutter guard device of claim 1, wherein a structure of the at least one truss has a first wall of the fold joined to an opposing second wall of the fold via a connecting top of the fold.

4. The gutter guard device of claim 3, wherein the first and second walls are disposed perpendicular to the bridge member.

5. The gutter guard device of claim 1, wherein the at least one truss is disposed at an angle from a plane of the top surface of the bridge member.

6. The gutter guard device of claim 2, wherein the plurality of trusses are equidistant from each other.

7. The gutter guard device of claim 2, wherein a truss of the plurality of trusses spans the bridge member in a non-orthogonal orientation.

8. The gutter guard device of claim 2, wherein a truss of the plurality of trusses is bifurcated.

9. The gutter guard device of claim 1, wherein a portion of the at least one truss protruding on at least one of the gutter attachment member and roof attachment member has a reduced profile.

10. The gutter guard device of claim 9, wherein the reduced profile is obtained by flattening the portion.

11. The gutter guard device of claim 1, wherein a length of the at least one truss is less than a length between the bridge member's roof side and gutter lip side.

12. The gutter guard device of claim 1, wherein the at least one truss has a cross-sectional profile shape of an inverted "U".

13. The gutter guard device of claim 1, further comprising at least one barricade disposed in the bridge member.

14. The gutter guard device of claim 13, wherein the at least one barricade has a shape of at least one of a number, letter, circle, arrow, crescent, bump, dimple, and polygon.

15. The gutter guard device of claim 13, wherein the at least one barricade is a plurality of barricades.

16. The gutter guard device of claim 13, wherein the at least one barricade is not made from the bridge member's decking material.

17. The gutter guard device of claim 1, wherein a first section of the roof side has a first elevation and a second section of the gutter side has a second elevation, the first and second sections being joined together by a third section, to form a non-linear bridge member profile, wherein a profile of the at least one truss is matched to the bridge member's profile.

18. The gutter guard device of claim 17, wherein the first and second elevations are the same and the third section contains an apex, to form a peak.

19. The gutter guard device of claim 17, wherein the first and second elevations are the same and the third section contains an inverted apex, to form a trough.

20. The gutter guard device of claim 1, wherein the roof attachment member is flexible, allowing it to be deformed into different attachment angles.

21. The gutter guard device of claim 1, wherein an upper portion of the at least one truss is angled with respect to a lower portion of the at least one truss.

22. The gutter guard device of claim 2, further including at least one of a regular shaped and irregular shaped groove disposed in the bridge member between the plurality of trusses.

23. The gutter guard device of claim 22, wherein the at least one regular shaped and irregular shaped groove is a plurality of grooves.

24. The gutter guard device of claim 22, wherein a first cross-sectional profile of the at least one regular shaped and irregular shaped groove has a shape of at least one of a hexagon, half-hexagon, triangle, box, sinusoid, off center, dip, and V.

25. The gutter guard device of claim 22, wherein a second cross-sectional profile of the at least one regular shaped and irregular shaped groove has a different shape than the first cross-sectional profile's shape.

26. The gutter guard device of claim 22, wherein a second cross-sectional profile of the at least one groove has a different size than a size of the first cross-sectional profile's shape.

27. The gutter guard device of claim 22, wherein a first groove of the at least one groove is in a reversed orientation to a second groove of the at least one groove.

28. The gutter guard device of claim 22, wherein an end profile of the at least one regular shaped and irregular shaped groove forms a train of angled segments.

29. The gutter guard device of claim 28, wherein the train includes a curved segment.

30. The gutter guard device of claim 1, further comprising a trough disposed in the bridge member and proximal to the gutter attachment member.

31. The gutter guard device of claim 30, wherein the trough contains at least one screened window.

32. The gutter guard device of claim 1, wherein at least one of the roof side and the gutter lip side is non-orificed.

* * * * *